US011033767B2

(12) United States Patent
Phillips et al.

(10) Patent No.: US 11,033,767 B2
(45) Date of Patent: Jun. 15, 2021

(54) GUIDED MOVEMENT EXERCISE MACHINE

(71) Applicant: ENGEN FITNESS, INC., Cave Creek, AZ (US)

(72) Inventors: Harry J. Phillips, Cave Creek, AZ (US); Douglas D. Udall, Cave Creek, AZ (US)

(73) Assignee: ENGEN FITNESS, INC., Cave Creek, AZ (US)

( * ) Notice: Subject to any disclaimer, the term of this patent is extended or adjusted under 35 U.S.C. 154(b) by 62 days.

(21) Appl. No.: 16/475,652

(22) PCT Filed: Dec. 27, 2017

(86) PCT No.: PCT/US2017/068530

§ 371 (c)(1),
(2) Date: Jul. 2, 2019

(87) PCT Pub. No.: WO2018/128891

PCT Pub. Date: Jul. 12, 2018

(65) Prior Publication Data

US 2019/0344112 A1 Nov. 14, 2019

Related U.S. Application Data

(60) Provisional application No. 62/441,898, filed on Jan. 3, 2017.

(51) Int. Cl.
*A63B 21/00* (2006.01)
*A63B 21/005* (2006.01)
(Continued)

(52) U.S. Cl.
CPC .... *A63B 21/00076* (2013.01); *A63B 21/0058* (2013.01); *A63B 21/0083* (2013.01);
(Continued)

(58) Field of Classification Search
CPC ... A63B 21/00; A63B 21/004; A63B 21/0047; A63B 21/02; A63B 21/0023;
(Continued)

(56) References Cited

U.S. PATENT DOCUMENTS 3,213,852 A * 10/1965 Zent ..... A63B 22/001 601/36
4,643,418 A * 2/1987 Bart ..... A63B 22/02 482/4

(Continued)

FOREIGN PATENT DOCUMENTS

CN 205516186 U 8/2016
EP 0621058 A1 10/1994

OTHER PUBLICATIONS

International Search Report and Written Opinion of the International Searching Authority for International Application No. PCT/US2017/068530, dated Mar. 5, 2018, in 13 pages.

(Continued)

*Primary Examiner* — Gary D Urbiel Goldner
*Assistant Examiner* — Thao N Do
(74) *Attorney, Agent, or Firm* — Knobbe, Martens, Olson & Bear, LLP

(57) ABSTRACT

An exercise machine can include a frame, one or more platform arms that can be driven by a motor or a hydraulic system, and one or more handle arms that can be grasped by the user's hands. The exercise machine can guide the user through movement that actively flexes and extends portions of a user's body while the user exercises to provide, for example, dynamic stretching and cardio benefits while achieving strength training.

14 Claims, 32 Drawing Sheets

(51) Int. Cl.
*A63B 21/008* (2006.01)
*A63B 22/00* (2006.01)
*A63B 22/04* (2006.01)
*A63B 71/00* (2006.01)

(52) U.S. Cl.
CPC ..... *A63B 21/159* (2013.01); *A63B 21/4035* (2015.10); *A63B 22/001* (2013.01); *A63B 22/04* (2013.01); *A63B 2071/0063* (2013.01)

(58) Field of Classification Search
CPC ..... A63B 21/00054; A63B 21/00058; A63B 21/00061; A63B 21/00065; A63B 21/00072; A63B 21/00076; A63B 21/000178; A63B 21/00181; A63B 21/00185; A63B 21/00189; A63B 21/00192; A63B 21/00196; A63B 21/002; A63B 21/005; A63B 21/0055; A63B 21/0058; A63B 21/0059; A63B 21/008; A63B 21/0083; A63B 21/0087; A63B 21/0085; A63B 21/0088; A63B 21/012; A63B 21/026; A63B 21/027; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/078; A63B 21/08; A63B 21/15; A63B 21/151; A63B 21/158; A63B 21/159; A63B 21/16; A63B 21/1627; A63B 21/1681; A63B 21/22; A63B 21/222; A63B 21/225; A63B 21/227; A63B 22/0002; A63B 22/0005; A63B 22/0007; A63B 22/001; A63B 22/0012; A63B 22/0015; A63B 22/0017; A63B 22/0046; A63B 22/0048; A63B 22/0056; A63B 22/0058; A63B 22/0061; A63B 22/14; A63B 22/0064; A63B 22/0066; A63B 22/0069; A63B 22/0084; A63B 22/0087; A63B 22/0089; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 22/04; A63B 22/06; A63B 22/0605; A63B 22/0664; A63B 22/16; A63B 22/18; A63B 22/20; A63B 22/201; A63B 22/203; A63B 22/205; A63B 22/208; A63B 2022/0028; A63B 2022/003; A63B 2022/0033; A63B 2022/0035; A63B 2022/0038; A63B 2022/0041; A63B 2022/0043; A63B 2022/0051; A63B 2022/0053; A63B 2022/0071; A63B 2022/0074; A63B 2022/0092; A63B 2022/0094; A63B 2022/0271; A63B 2022/0278; A63B 2022/0611; A63B 2022/0617; A63B 2022/0623; A63B 2022/206; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688; A63B 2022/185; A63B 23/0458; A63B 23/0464; A63B 23/12; A63B 23/00; A63B 23/035; A63B 23/03508; A63B 23/03516; A63B 23/03525; A63B 23/03533; A63B 23/03541; A63B 23/0355; A63B 23/03558; A63B 23/03566; A63B 23/03575; A63B 23/03583; A63B 23/03591; A63B 23/04; A63B 23/0405; A63B 23/047; A63B 23/0476; A63B 23/0482; A63B 23/0488; A63B 23/0494; A63B 23/08; A63B 23/0855; A63B 23/10; A63B 23/1254; A63B 23/1263; A63B 23/1272; A63B 23/1281; A63B 23/16; A63B 23/18; A63B 2023/003; A63B 2023/006; A63B 2023/02; A63B 2023/0205; A63B 2023/0211; A63B 2023/0216; A63B 2023/0222; A63B 2023/0227; A63B 2023/0233; A63B 2023/0417; A63B 2023/0423; A63B 2023/0429; A63B 2023/0447; A63B 2023/0452; A63B 24/00; A63B 24/0003; A63B 24/0006; A63B 24/0087; A63B 2024/0009; A63B 2024/0012; A63B 2024/0015; A63B 2024/0018; A63B 69/00; A63B 69/0022; A63B 69/0028; A63B 69/0057; A63B 69/0062; A63B 69/18; A63B 69/182; A63B 2069/0031; A63B 2069/0033; A63B 2071/0063; A63B 2071/0072; A63B 2208/00; A63B 2208/02; A63B 2208/0204; A63B 2208/0209; A61H 1/00; A61H 1/02; A61H 1/0214; A61H 1/0237; A61H 1/024; A61H 1/0244; A61H 2001/0211; A61H 2203/04; A61H 2203/0406; A61H 2205/088; A61H 2205/10; A61H 2205/106; A61H 2205/108; A61H 2205/102; A61H 2205/12; A61H 2205/125
USPC ..... 482/53
See application file for complete search history.

(56) References Cited

U.S. PATENT DOCUMENTS

| | | | | | |
|---|---|---|---|---|---|
| 5,050,865 | A * | 9/1991 | Augspurger | A63B 69/16 | 482/2 |
| 5,071,115 | A * | 12/1991 | Welch | A63B 22/0056 | 482/53 |
| 5,180,351 | A | 1/1993 | Ehrenfried | | |
| 5,308,300 | A | 5/1994 | Chino et al. | | |
| 5,707,321 | A | 1/1998 | Maresh | | |
| 5,746,684 | A | 5/1998 | Jordan | | |
| 5,848,954 | A * | 12/1998 | Stearns | A63B 22/0012 | 482/52 |
| 5,916,065 | A | 6/1999 | McBride et al. | | |
| 6,019,710 | A | 2/2000 | Dalebout et al. | | |
| 6,077,198 | A | 6/2000 | Eschenbach | | |
| 6,251,050 | B1 | 6/2001 | Johnston | | |
| 6,277,056 | B1 | 8/2001 | McBride et al. | | |
| 6,755,769 | B2 | 6/2004 | Johnston | | |
| 7,052,438 | B2 | 5/2006 | Eschenbach | | |
| 7,270,626 | B2 * | 9/2007 | Porth | A63B 22/001 | 482/52 |
| 7,341,542 | B2 * | 3/2008 | Ohrt | A63B 22/0017 | |
| 7,704,191 | B2 * | 4/2010 | Smith | A63B 22/0056 | 482/51 |
| 7,744,508 | B2 * | 6/2010 | Liao | A63B 22/0015 | 482/52 |
| 7,878,950 | B1 * | 2/2011 | Bastian | A63B 22/0235 | 482/54 |
| 9,186,541 | B1 * | 11/2015 | Murray | A63B 22/201 | |
| 9,199,115 | B2 | 12/2015 | Yim et al. | | |
| 9,199,116 | B1 * | 12/2015 | Huang | A63B 22/0664 | |
| 9,199,155 | B2 | 12/2015 | Skory et al. | | |

(56) References Cited

U.S. PATENT DOCUMENTS

| | | | | |
|---|---|---|---|---|
| 9,272,180 | B2 | 3/2016 | Eschenbach | |
| 10,874,208 | B1 * | 12/2020 | Knapp | A47B 23/06 |
| 2003/0022764 | A1 | 1/2003 | Johnston | |
| 2003/0092532 | A1 | 5/2003 | Giannelli et al. | |
| 2004/0043871 | A1 | 3/2004 | Chang | |
| 2004/0214693 | A1 * | 10/2004 | Piaget | A63B 22/0235 482/52 |
| 2006/0058159 | A1 | 3/2006 | Eschenbach | |
| 2006/0293153 | A1 * | 12/2006 | Porth | A63B 22/0664 482/52 |
| 2007/0072743 | A1 * | 3/2007 | Severino | A63B 22/0242 482/54 |
| 2007/0254778 | A1 | 11/2007 | Ashby | |
| 2007/0298935 | A1 * | 12/2007 | Badarneh | A63B 22/0664 482/52 |
| 2008/0139366 | A1 | 6/2008 | Born et al. | |
| 2013/0345025 | A1 * | 12/2013 | van der Merwe | A63B 22/0605 482/7 |
| 2014/0080675 | A1 * | 3/2014 | Anderson | A63B 21/227 482/52 |
| 2015/0182784 | A1 | 7/2015 | Barriskill et al. | |
| 2016/0346599 | A1 * | 12/2016 | Dalebout | A63B 22/0015 |
| 2017/0056706 | A1 * | 3/2017 | Finlayson | A63B 21/225 |
| 2017/0224571 | A1 * | 8/2017 | Pisano | A61H 1/005 |

OTHER PUBLICATIONS

Bowflex, Bowflex Product No. Bowlex Max Trainer M5, downloaded from http://www.bowflex.com/max-trainer/m5/100359.html, available before Jan. 3, 2017.

Stepper Machine, Land Fitness Product No. LDE 04 Stepper Machine, downloaded from http://www.landfitech.com/en/prolist.aspx?id=28, available before Jan. 3, 2017.

* cited by examiner

GUIDED MOVEMENT EXERCISE MACHINE

CROSS-REFERENCE TO RELATED APPLICATION

This application is the U.S. National Phase under 35 U.S.C. § 371 of International Application PCT/US2017/068530, filed Dec. 27, 2017, which claims priority to U.S. Provisional Application No. 62/441,898, filed Jan. 3, 2017, the entirety of each of which is incorporated herein by reference and made a part of this specification.

BACKGROUND

Field

The present disclosure generally relates to exercise machines, particularly to full-body exercise machines.

Description of the Related Art

Exercise machines are known that provide resistance exercise to a user. Such machines may allow a user to exercise in, for example, a stair-climbing motion or an elliptical motion similar to running. The user of such a machine generally exerts forces to overcome the resistance provided by the machine through, for example, foot pedals that can move along a closed-loop path. Some machines may comprise handles that are connected to the foot pedals and move with the foot pedals. Such machines may seek to combine both upper and lower body exercise. Problems exist with these types of conventional exercise machine. For example, some users may not find the type of exercise possibly using conventional exercise machines interesting and accordingly have difficulty staying motivated to continue the exercise long enough to derive benefits therefrom. Some users may also not find the type of exercise enabled by conventional exercise machines to be an intense stimulation of certain muscle groups.

SUMMARY

A need exists for exercise machines that eliminate, reduce, or alleviate the monotony (e.g., difficulty staying motivated) and discomfort of conventional machines while providing stimulation of certain desired muscle groups. Partly because of the limited range of motion provided by conventional exercise machines discussed herein and the lack of external stimulation that provides a guided movement by an exercise machine moving the user in certain ways as discussed herein, users may not be able to sufficiently stretch the exercised muscle groups while simultaneously exercising or intensely exercising as desired. For example, conventional exercise machines, such as a stair-stepper or an elliptical, that do not have an external driving force may not provide eccentric muscle contractions, e.g. exercise involving muscles or muscle groups lengthening under load. Additionally, exercise machines such as treadmills, elliptical machines, stationary cycles, rowing machines, and stair steppers, may engage different muscle groups depending on the type of machine and may not reinforce stimulation of certain targeted muscle groups.

As an example, conventional stair-stepper-type exercise machines suffer from a number of limitations and disadvantages. In some stair-stepper-type exercise machines, the user exercises by pushing down one foot against the machine while the other foot remains in contact with the machine, but without being actively pushed up by the stair-stepper. This may convey the impression to the user that the user is performing a constrained and unnatural type of motion while exercising only a limited group of muscles. As another example, elliptical exercise machines constrain the user's feet and legs into a circular/elliptical motion in the user's sagittal plane. The circular/elliptical motion can be an unnatural and unintuitive movement for the human body. For example, a person does not move his/her feet in a circular/elliptical motion while walking or running. Further, a person does not push forward while walking or running as required when exercising on the elliptical. Such a forced circular/elliptical motion may cause excessive strain and damage to ankles, knees, and/or hips while also exercising only a limited group of muscles. As another example, a treadmill exercises a user by having him/her hit a relatively hard surface (e.g., platform of the treadmill) while walking or running. Such pounding of the user's body against a hard surface may cause excessive strain and damage to ankles, knees, and/or hips while also exercising only a limited group of muscles.

In addition, the above conventional exercise machines do not permit the user to fully extend his/her leg during the exercise cycle, and may only permit, if at all, a slight bend of the knees. This again limits the range of motion being performed for reduced muscle exercising and limited stretching of the muscles. Some users may also, especially when fatigued, fall into an unhealthy passive posture, such as a hunched position, further possibly increasing strain and damage to a user's body while limiting stretching.

As such, a need exists for novel exercise machines that actively induce the exercising motions of a user's muscles as a guided movement and that combine cardiovascular exercise with stretching. The present disclosure provides, in some embodiments, exercise machines incorporating various improvements for a full body workout. Various benefits provided by exercise machines according to the present disclosure may include, for example, cardiovascular exercise, dynamic stretching, core endurance, improvement of muscle tone, and strength increase while reducing exercise time relative to conventional exercise machines. Stated differently, the exercise machines disclosed herein can in some embodiments allow developing and maintaining cardiovascular health, flexibility and range of motion, and muscle tone and strength while providing the health benefits of movement with a substantially zero-impact on exercise (e.g., relatively no or little impact on the knees as may be experienced on a treadmill). The exercise machines may cater to the needs of a wide variety of different user types, such as the elderly, fitness enthusiasts, and professional athletes.

As discussed above, when using conventional exercise machines, a user normally exerts physical effort or force to move the machine. According to some embodiments of the present disclosure, the machines disclosed herein may exert forces to induce and guide active, coordinated movement of the whole body in the user. The user may thus move in coordination with and in reaction to the movements of the machine. The forces that induce active movement in the user may be transmitted by movements of the foot stands and grip system that are designed to engage the body in athletic motion. The foot stands move up and down along a slightly arced path or a substantially linear vertical path while hand grips simultaneously move along a slightly arced path or a substantially linear horizontal path. Both foot stands and hand grips may allow for adjustment to set the travel length. In some embodiments, the foot stands may be set to move together (e.g., at the same level) or can be offset to move in opposition; the motion of the foot stands may be similar to a natural squatting or stair-stepping motion. The hand grips, which can be placed at various heights and widths, can also be set to move together or in opposition; the motion of the hand grips may be similar to a rowing or cycling motion.

In some embodiments, the exercise machine disclosed herein may position the user in an athletic posture, e.g., wherein the user's feet placed on independent foot stands that support about or at least about 80% of the user's body weight while the user is leaning forward. The user's upper body may be angled forward, and at least some or substantially all of the upper body weight may be supported through hands on a hand grip system. The foot stands and grip system may travel along pre-set paths driven by, for example, a driver providing a substantially circular driving motion (e.g., a DC (direct current) driven electric motor) and/or other types of drivers providing a substantially linear/reciprocating driving motion (e.g., a stepper motor and/or hydraulic system) to the foot stands.

The speed of the motor or hydraulic system may be changed by the user to induce movement of varying intensity and speed, thus allowing the user to select a target intensity ranging from gentle warmup and stretching, through moderate cardiovascular exercise or cardio, to high intensity workouts and whole body endurance training. For example, the intensity of the workout can be controlled by adjusting the repetitions per minute (RPMs) of the machine. At lower motor speeds, users are provided with a simple and effective means for warmup and stretching. At higher motor speeds, users are provided with an intense muscle and/or cardio workout.

As disclosed herein, the user is guided by the motor-induced motion of the machine. The user may choose to exercise by resisting the movement of the machine, or may move slightly ahead of the machine, thus anticipating the machine's motion. Alternatively, the user may simply choose to follow the movement or motion pattern of the machine.

The movements of the machine guide users through a predetermined range of motion in, for example, any number of the ankles, knees, hips, abdomen, back, shoulders, elbows, and wrists. This movement can be accompanied by stretching of, for example, the back, shoulders, arms, buttocks, legs, and feet as well as flexing of, for example, the ankles, knees, hips, shoulders, elbows, and wrists. The result is a thorough dynamic stretching and increased circulation to the large and even minor muscles of the body. Higher motor speeds may allow cardiovascular exercise; at sufficient speed, depending on the fitness level of the user, the movements of the upper and lower body in combination with the work performed by the core muscles result in significant elevation of heart rate and respiratory, as well as caloric burn and oxygen consumption, for example. When positioned on the exercise machine as disclosed herein, the user bends his/her legs in coordination with the movement of the foot stands. With the foot stands moving together, the lower body may perform repeated reverse squats. With the foot stands in opposition, the lower body movement may resemble running or high stepping. The exercise machine may facilitate relatively deeper knee bends via, for example, lifting of the leg. The upper body, with the hand grips moving together or in opposition, is engaged in a rowing or cycling type motion. The intensity of the core workout can vary with the speed of the machine and the travel length of the foot stands and hand grips.

The overall positioning of the body on the moving platform may engage the user's core muscles, and forces generated by movements of the machine are counteracted by the user's core muscles to maintain balance and stability. The squatting or stepping motion of the lower body may require or induce intentional and active movement of the largest muscles in the abdomen, buttocks, and legs. A rowing or cycling motion of the upper body may require or induce active movement of the large muscles in the back as well as the shoulders, chest, and arms.

In some embodiments, the motor-assisted lifting of the feet may extend beyond the user's natural range of motion, or the range of motion that the user would be able to accomplish without assistance. Extending a range of motion during exercise may allow for an increased stretching effect on the muscle groups in, for example, the knees and feet. For example, the exercise machine can actively guide a user through a natural range of motion in the ankles, knees, hips, shoulders and elbows. This movement is accompanied by stretching of the back, shoulders, hips, thighs, calves and ankles. The result is a thorough dynamic stretching and increased circulation throughout the body. The same stretching effect is experienced during higher RPM workouts. Regular use of the exercise machine can increases lean body mass and help develop muscles in the arms and legs. The unique core twisting motion of the upper body engages, for example, the obliques and tones the abdomen.

In some embodiments, the user may hold a posture while exercising on the machine in which the user's hands support the user's body weight. For example, the user may be placed in a posture where roughly or about 80% of his body weight is being supported by his feet and the remaining about 20% of his body weight is being supported by his hands. In other embodiments, about 70%, about 75%, about 85%, or about 90%, about 95%, or about 100% of the user's body weight (or ranges incorporating any two of the aforementioned values) may be supported by their feet, with any balance supported by the user's hands. Advantageously, this design allows for the user to be in a tensioned and athletic posture while exercising on the machine so that the effect of the exercise is maximized and the risk of injury is minimized.

In some embodiments, the machine may be configured so as to allow for full extension of a user's arms and legs during the exercise cycle. Full extension may allow for a more natural motion during the exercise and may allow the user to experience stretching of certain muscle groups while exercising on the machine.

In the present disclosure, anatomical terms are used to reference directions and planes of motion of the user. In some embodiments, the exercise machine may allow the user to exercise by movement of the hands and/or feet in the sagittal plane, while simultaneously substantially limiting, inducing, or guiding the user's feet to move along one coronal plane. The exercise machine may allow the user to exercise by movement of the hands and/or feet in the sagittal plane, while simultaneously substantially limiting, inducing, or guiding the user's hands so as to limit the movement of the user's hands to one transverse plane.

Some embodiments according to the present disclosure may combine these features and thus allow the user to exercise by movement of the hands and/or feet in the sagittal plane, while limiting, inducing, or guiding the user's hands to move in one transverse plane or substantially along the one transverse plane, and while limiting, guiding, or inducing a movement of the user's feet in one coronal plane or substantially along the one coronal plane.

In some embodiments, the exercise machine may substantially inhibit or limit movement of the user's feet in the transverse plane and substantially inhibit or limit movement of the user's hands in the coronal plane. From a user's perspective, the user's feet and knees follow substantially the same up and down linear trajectory during the extension and the contraction phase of the exercise cycle. This may avoid rotation, and thus eliminate or reduce the need for rotatable foot stands. In some embodiments, the use of non-rotatable foot stands may facilitate the user's heels to partially lift off during part of the exercise cycle, thus advantageously facilitating for dynamic stretching of the user's Achilles tendon and surrounding muscles. This may also contribute to decreased stress on the user's knee and hip. In some embodiments, the up and down trajectory may be configured to extend sufficiently far towards the user so as to induce a substantial or a full flexion in the user's knee during part of the cycle. In some embodiments, the up and down trajectory may be configured to extend sufficiently to allow for the user's knee to be substantially or fully extended. The user's motion and posture may be considered similar to performing a half-body squat or crunch.

Similarly, the user's hands and feet may follow substantially the same back and forth linear trajectory during the extension and during the contraction phase of the exercise cycle. This may eliminate or reduce circular or elliptical components of the user's hands and feet during the exercise, and thus contribute to decreased stress on the user's shoulder, elbow, and/or wrist joints. The reduced circular or elliptical components of motion may also allow the user to assume a more natural and comfortable position while exercising. This may also contribute to decreased stress on the user's wrist and elbow.

In some embodiments, the exercise machines disclosed herein may also be used as a resistance training tool by actively opposing the movement of the machine. This may be particularly useful for strength straining. Working against the machine, the user exerts force in a manner similar to resistance training. When the foot stands are traveling upwards, the user can press down against the upward movement of the stands using, for example, the feet, legs and buttocks. Repetitions of this effort may exercise the user's lower body. The user can also exercise by opposing the motion of the hand grips as they travel towards the body, effecting what amounts to a reverse (e.g. eccentric) pushup, and/or as the hand grip travel away from the body. Additionally, the exercise machines may provide a strength training mode by manually working the foot stands and hand grip. In strength training mode, the standing leg press and upper body rowing workouts may be an effective alternative or addition to conventional weight training or body weight exercises as well as providing cardiovascular benefits.

To accommodate different standing positions as well as different configurations of the vertical movement as discussed herein, the range of motion of the handle arms may be adjusted independently from the foot stands in some embodiments. This may accommodate users of different sizes and different preferences as to the length of the desired arm stroke during a cycle of the machine. For example, the positions of the hand grip may be adjusted so as to accommodate a male adult user, a female adult user, or a child user. Adjusting the position and range of motion of the handle arms may also allow the user to select different postures while exercising; for example, the user may be able to set the range of motion so as to bring the handle arms closer to the user's body when desiring a relatively straight/up-right exercise position (e.g. a position such as may be similar to a skiing posture); conversely, the user may set the range of motion so as to move the handle arms further away when desiring a cantilevered, or flexed-back, exercise position (e.g. an athletic position such as may be similar to a cycling posture).

In some embodiments, a grip handle or a structure comprising several grip handles may be connected to the control arms. This may allow the user to grip the control arms in different positions, thus allowing the user to exercise with varying orientations of the user's hands and arms and thus to emphasize different muscle groups, for example, in the arms, shoulders, chest, and back, while other muscle groups are engaged. The hand grip may comprise a structure or mesh so as to allow for different positions of the hand grip; for example, the hand grip may allow one or more supinated hand grip positions and one or more pronated hand positions. A hand grip system may include a rectangular shaped matrix that provides the user with, for example, 12 different hand positions on the hand grip system.

In some embodiments, a DC motor for the platform arms, double/dual-acting hydraulic cylinders, or double/dual-stepper motors may be used for each platform arm. The use of certain DC motors in combination with crank mechanisms as discussed herein and/or hydraulic cylinders may allow for more quiet operation and may allow the machine to be built more compactly.

In some embodiments, an exercise machine according to the present disclosure may be driven by a DC motor, stepper motor, and/or hydraulic system attached to a frame of the exercise machine, for example using brackets and hardware. The DC motor, stepper motor, and/or hydraulic system may provide variable speed through the use of a driver circuit controlling the speed, thus offering low to high speed changes at the motor's output. In the case of the motor, the motor may have a chain and sprocket type drive, optionally including reduction gearing, wherein the chain drives a sprocket crank having crank rods attached to it. Other suitable mechanism for linking the motor and drive system (e.g., tension belts) may be used. To allow for mounting of the motor in a suitable (e.g. vertical) position, one or more idler gears may be used between the motor and the chain and sprocket drive. Advantageously, the one or more idler gears may also provide for at least some mechanical advantage (e.g. additional reduction) between the motor and the chain and sprocket drive. Accordingly, the exercise machine may provide for a variety of different speeds. The user may be able to set the speed at which the machine is operating using a control panel before or while exercising. This allows for the user to choose the intensity and type of exercise; for example, the user may choose to perform a light warmup, to perform a medium-intensity fat-burning workout or to perform a high-intensity endurance workout.

As disclosed herein for some embodiments, the rotary motion transferred through the sprocket crank provides for a bottom dead center position and a top dead center position. The left and right sides of the sprocket crank have crank rods attached to center pivots. The opposite ends of the crank rods are connected to connecting rods, which are attached to platform arms. By pivoting around a platform hinge, this mechanism translates the sprocket crank's rotary motion into a radial angular motion about a pivot or a substantially vertical motion relative to or from the user's perspective. Brackets coming off the frame may affix the platform hinge. The radial angular motion may drive the feet and legs to move in a fluid up and down movement with the left and right side legs 180 degrees out of phase to one another. At a midpoint of the frame may be a tower support that locates brackets that hold a tower hinge, connecting to the left and right side upper control arms. The upper arms locate brackets and connections for hinges connecting the platform arms and the upper control arms.

In some embodiments, a bracket comes from the platform hinge down each platform arm and positions a pivot point where each platform arm is connected to another pivot on its corresponding upper control arm. This link transfers the motion of the platform arms to the upper control arms, providing an oscillating rotary angular motion for the left and right side upper control arms. On each platform arm, a foot stand area may be located which provides space for various foot positions of the user. On the forward end of the platform arm is another bracket that locates and positions a pivot point connecting a lower control arm, which is connected through another pivot point to the platform arm, providing another radial angular motion to the lower control arm.

In some embodiments, through another hinge and a lower/upper control linkage bracket, the radial angular motion from the left and right upper control arm and the left and right lower control arm are combined and impart an oscillating movement of the left and right hand grip system converting it to a radial angular motion or substantially horizontal movement which drive the user's arms in a forward and backward movement. A hand bar adjustment linkage may be connected to the hand grip system which provides for different hand grip system positions relative to the user's size and desired length of arm stroke.

In some embodiments, a crank mechanism to drive and guide the motion of the user via the machine as discussed herein may be driven by an electric motor. For example, a direct current motor may be used. A direct current motor may allow for easy variation of the motor speed and thus of the speed at which the machine operates. The motor may be attached to the frame of the machine by brackets and screws and may, for example, be connected to the crank mechanism through a chain drive or other gearing mechanism that provides for gear reduction. Gear reduction may allow for the motor to operate at near its rotation rate for optimal power or efficiency, while allowing the machine to operate at a slower rate.

In some embodiments, the machine may comprise damping shock absorbers and/or springs between the platform arms and the frame. Damping shock absorbers and/or springs may smooth out the motion of the machine, particularly at the top dead center and bottom dead center positions of the crank mechanism that drives the motion via, e.g., the platform arms. For example, left and right damping shock absorbers and/or springs may be located and positioned on the frame and connected to the left and right side platform arms by use of brackets and hardware, so as to reduce the top dead center and bottom dead center position hard over points and maintain a substantially smooth motion continuously through the cycle of the machine.

In some embodiments, the damping shock absorbers and/or springs may also permit the user to operate the machine without the assistance of the electric motor by providing resistance against the user's motion or movements, and thus allow exercise without an external source of power provided to the machine. Additionally, using the damping shock absorbers and/or springs allows for exercise-induced vibrations from the machine to be dissipated rather than being transferred to the user and/or the environment, where they could cause potentially hazardous oscillations of the machine or other types of hazards and nuisances to the user. For example, the damping shock absorbers and/or springs may reduce and balance the workload of the motor, providing a smoother motion cycle when the user is on the machine. The damping shock absorbers and/or springs either decrease or increase the load on the motor depending on where in the motion cycle the exercise machine is.

In some embodiments, the machine may include one or more springs (with or without damping shock absorbers) that are periodically tensioned and relieved as the machine moves through its cycle. Advantageously, this may allow for the load on the motor to be evened out over the cycle of the machine and thus may permit for a smaller and less complex motor and less powerful motor driver electronics to be used.

In some embodiments, a user may be able to vary the speed and/or range of the vertical motion by varying his/her position (e.g., position or posture on the machine) on the exercise machine. Some embodiments may provide for foot stands that provide sufficient space for the user to assume various positions on the exercise machine to accommodate a user's preference for vertical motion. In some embodiments, the foot stands may allow for adjustability of around 2 feet, or more. For example, the adjustment range may be up to about 4 inches, up to about 8 inches, up to about 12 inches, up to about 16 inches, up to about 20 inches, up to about 24 inches, up to about 28 inches, up to about 30 inches, or up to about 36 inches, including the foregoing values and ranges bordering therein, so as to allow the user to assume a foot position within this range.

This Summary is provided to introduce a selection of concepts in a simplified form. The concepts are further described in the Detailed Description section. Elements or steps other than those described in this Summary are possible, and no element or step is necessarily required. This Summary is not intended to identify key features or essential features of the claimed subject matter. The claimed subject matter is not limited to implementations that solve any or all disadvantages noted in any part of this disclosure.

BRIEF DESCRIPTION OF THE DRAWINGS

The foregoing and other features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1A:
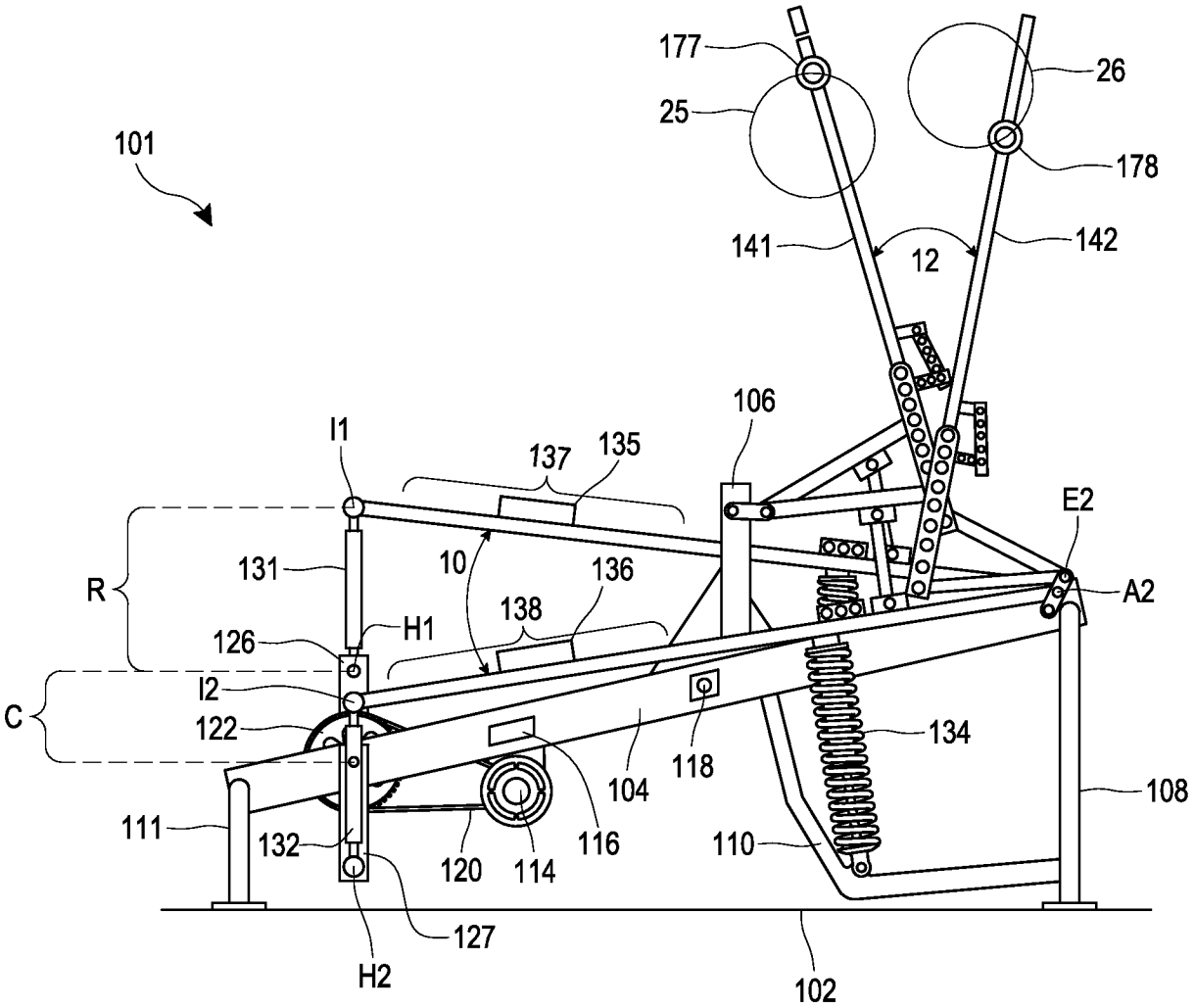
FIG. 1A illustrates a side view of an exercise machine according to some embodiments.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and made a part of this disclosure.

In particular, embodiments disclosed herein pertain to exercise machines, which can allow a user to exercise and/or stretch, various muscle groups.

It may aid understanding of the various embodiments to describe various directions and planes using the anatomical coordinate system of a user on the machine. Such an anatomical coordinate system may define various planes, such as sagittal planes, transverse planes, and coronal planes. It will be appreciated that an infinite number of planes exists parallel to the planes illustrated. As such, when referring to "the sagittal planes", "the coronal planes", or "the transverse planes", all planes parallel to a sagittal, coronal, or transverse plane of the user are included.

According to some embodiments, the exercise machine 101 as illustrated in and discussed with reference to FIGS. 1A, 1B, 1C, 1D, 1E, 2, 3, and 4, may include any one or more of the following components: a frame 104, a support tower 106, front floor stands 107, 108, a cantilever 110, rear floor stands 111, 112, an electric motor 114, a driver circuit 116, a control unit 118, a chain 120, a sprocket crank 122, crank rods 126, 127, connecting rods 131, 132, damping shock absorbers 133, 134, platform arms 135, 136, handle arms 141, 142, upper control arms 145, 146, lower control arms 151, 152, lever brackets 155, 156, upper link brackets 167*a*, 168*a*, lower link brackets 167*b*, 168*b*, platform brackets 171, 172, tubular hand grips 177, 178, and/or hand grip grids 303, 304.

The exercise machine 101 may also include any of the following rotational joints: platform hinges A1, A2, tower hinges B1, B2, platform arm link hinge C1, C2, control arm link hinges D1, D2, control arm hinge E1, E2, handle arm hinges F1, F2, fulcrum hinges G1, G2, crank joints H1, H2, connecting rod joints I1, I2, J1, J2, and second handle arm connections K1, K2.

Without limiting the disclosure herein, a high-level structure of the exercise machine 101 may include any one or more of the following. An electric motor 114 turns a sprocket crank or turning/driver wheel 122 through a chain 120. The sprocket crank 122 has crank rods 126, 127 attached to the sprocket crank 122. The crank rods 126, 127 can convert the rotational motion from sprocket crank 122 into linear reciprocating motion of the platform arms 135, 136 via connecting rods 131, 132 which may be attached via crank joints H1, H2. Accordingly, crank rods 126, 127 are linked to platform arms 135, 136 via connecting rods 131, 132. The platform arms 135, 136 are linked, and move together, with the handle arms 141, 142, through a set of linkages including lower control arms 151, 152 and upper control arms 145, 146. As a result, the torque from the electric motor 114 moves platform arms 135, 136 in a smooth up-and-down motion while the handle arms 141, 142 move in a synchronized back-and-forth motion. Platform arms 135, 136 have foot stands 137, 138 attached to them, allowing the user's feet to stand on them. Handle arms 141, 142 have hand grips, e.g. tubular hand grips 177, 178, attached to them, allowing the user's hands to grasp them.

The frame 104 may be made out of a rigid and tough material, for example, steel, aluminum, or suitable alloys. Advantageously, the frame may be formed out of sheet metal, such as steel or aluminum. The sheet metal may be formed by suitable manufacturing techniques, such as subtractive manufacturing laser cutting or water-jet cutting. The frame 104 rests on a floor, ground, or support surface 102 through the front floor stands 107, 108 and rear floor stands 111, 112. Support tower 106 protrudes substantially vertically from the frame 104.

An electric motor 114 can be mounted to the frame 104. The electric motor 114 can be electrically connected to a driver circuit 116, which provides the appropriate supply current for the electric motor 114. The driver circuit 116 can receive input from a control unit 118 to determine the speed (e.g., revolutions per minute) at which to run the electric motor 114. The driver circuit 116 may use any appropriate method known in the art, for example pulse-width modulation, to set or govern the speed of the electric motor 114. The driver circuit 116 may also receive information from the electric motor 114 about the angular position of the rotor in electric motor 114, and may use this information to determine or modulate the speed of electric motor 114. Electric motor 114 may include additional components to provide information about its angular position to driver circuit 116, such as a rotary encoder or a Hall Effect probe sensing the magnetic field of electric motor 114's rotor magnets.

Alternatively or additionally, the angular position of the electric motor 114 may be inferred from optical sensors placed in the path of travel of various components, such as sprocket crank 122, or crank rods 126, 127. The optical sensors may be configured as, for example, as an infrared light emitting diode illuminating a phototransistor, wherein crank 122, and crank rods 126, 127 are configured to interfere in the beam path between the diode and phototransistor. The optical sensors may be configured so that they sense one or more designated positions, such as a position in which handle arms 141, 142 are substantially level.

Advantageously, driver circuit 116 may utilize the information about the angular position to provide a closed feedback loop control of electric motor 114's speed and position, and may allow electric motor 114, to return to the one or more designated positions. Advantageously, electric motor 114 may be operated by driver circuit in various modes, such as a constant speed mode, a constant power mode and a positional hold mode. In a constant speed mode, the control unit 118 can control the electric motor 114 to control torque to match or substantially match and output a target rotational speed of crank 122. As such, if the user is exerting an increased level of resistance, the torque may be increased to keep the rotational speed of electric motor 114 up to its electrical and mechanical limits. In a constant power mode, the rotational speed is variable and is determined by the resistance of the user. In a position hold mode, control unit 118 may control and/or send a command signal to the driver circuit 116 to apply a voltage to move electric motor 114 into a predetermined position and then actively stay in that position by countering any externally applied torque. Advantageously, position hold mode may be engaged when the user is entering and exiting the machine; advantageously, the machine may, even though it may be asymmetrically loaded by a user entering or existing. Other modes may be specified; for example, the control unit 118 may control driver circuit 116 to operate on a torque curve or a power curve associating each given rotation rate with a target torque or power.

Driver circuit 116 and/or control unit 118 may comprise various safety features to protect electric motor 114 and connected components from damage, e.g. due to back-EMF (electromotive force), overheating or overspeed. Even within position hold mode or constant torque mode, driver circuit 116 may limit the current through electric motor 114 so as not to exceed the electrical and mechanical limits of electric motor 114 and/or any connected parts. In particular, driver circuit 116 may detect a stall of electric motor 114 and limit or disable the power applied to electric motor 114.

The driver circuit may be powered from a wall outlet, and may include appropriate rectification circuitry for use with a direct-current (DC) motor as electric motor 114. In some embodiments, a stepper motor may be used for the electric motor 114 to provide precise control over the angular position. The electric motor turns the chain 120, which turns the sprocket crank or turn wheel 122. In some embodiments, a belt or other linkage may be used in place of chain 120.

The sprocket crank 122 can have crank rods 126, 127 rigidly or fixedly attached to it. As illustrated, the crank rods 126, 127 are offset substantially equal distances from the center of rotation of the sprocket crank 122 and are located opposite to each other, so that crank rod 126 is in its top-dead center position when crank rod 127 is in its bottom-dead center position and vice versa as the sprocket crank 122 rotates as discussed herein. In some embodiments, when the crank rods 126, 127 are not offset and are at a substantially same radial position on the sprocket crank 122, the platform arms 135, 136 move together as discussed herein, to provide a motion similar to, for example, squatting.

As illustrated, the crank joints H1, H2 rotatably connect the crank rods 126, 127 with connecting rods 131, 132. Connecting rods 131, 132 are rotatably connected at their other ends to one end of the platform arms 135, 136 through connecting rod joints I1, I2. The sprocket crank 122, crank rods 126, 127, and connecting rods 131, 132 can be considered, at least in part, the crank linkage mechanism.

Platform arms 135, 136 can be connected on their other ends to platform hinges A1, A2. The resulting links between sprocket crank 122 and platform arms 135, 136 allow the platform arms 135, 136 to move in an arcing trajectory when the sprocket crank 122 rotates. An example range of motion 10 of the platform arms 135, 136 is illustrated.

In some embodiments, a protective screen or cover is provided between the user and the rotation area of the crank rods 126, 127 and connecting rods 131, 132, so as to prevent accidental contact between the user and the mechanism and the resulting risk of injury.

Platform arms 135, 136 may be rigid brackets made out of, for example, steel, aluminum, or any suitable alloy and has one of the foot stands 137, 138 rigidly connected to it. The foot stands 137, 138 may, for example, be rigid blocks with a top surface of anti-slip grated steel. In some embodiment, foot stands 137, 138 may comprise a user presence sensor 57. The user presence sensor 57 may be any appropriate sensing arrangement, including a mechanical sensor (e.g. a pressure-sensitive mat or lining, such as a piezo sensor), an optical sensor (e.g., a light barrier that is interrupted by the user's feet or legs), a capacitive sensor (e.g. a capacitance-sensing mat or lining that detects a user's presence by a chance in capacitance). User presence sensor 57 may also be implemented by sensing the weight or resistance of the user, such as via a back-EMF sensor connected to electric motor 114. The user presence sensor 57 may be connected to control unit 118.

The lengths C of the crank rods 126, 127, the lengths R of the connecting rods 131, 132, and the lengths P of the platform arms 135, 136 can be chosen based on the desired speed and trajectory of the machine 101. The length P of the platform arms 135, 136 can be chosen based on the desired maximum amplitude of foot motion desired. It will be appreciated that based on any given swept angle of the platform arms 135, 136, the maximum amplitude of oscillation is at the position furthest away from platform hinges A1, A2 and increases linearly with the length P.

Figure 8:
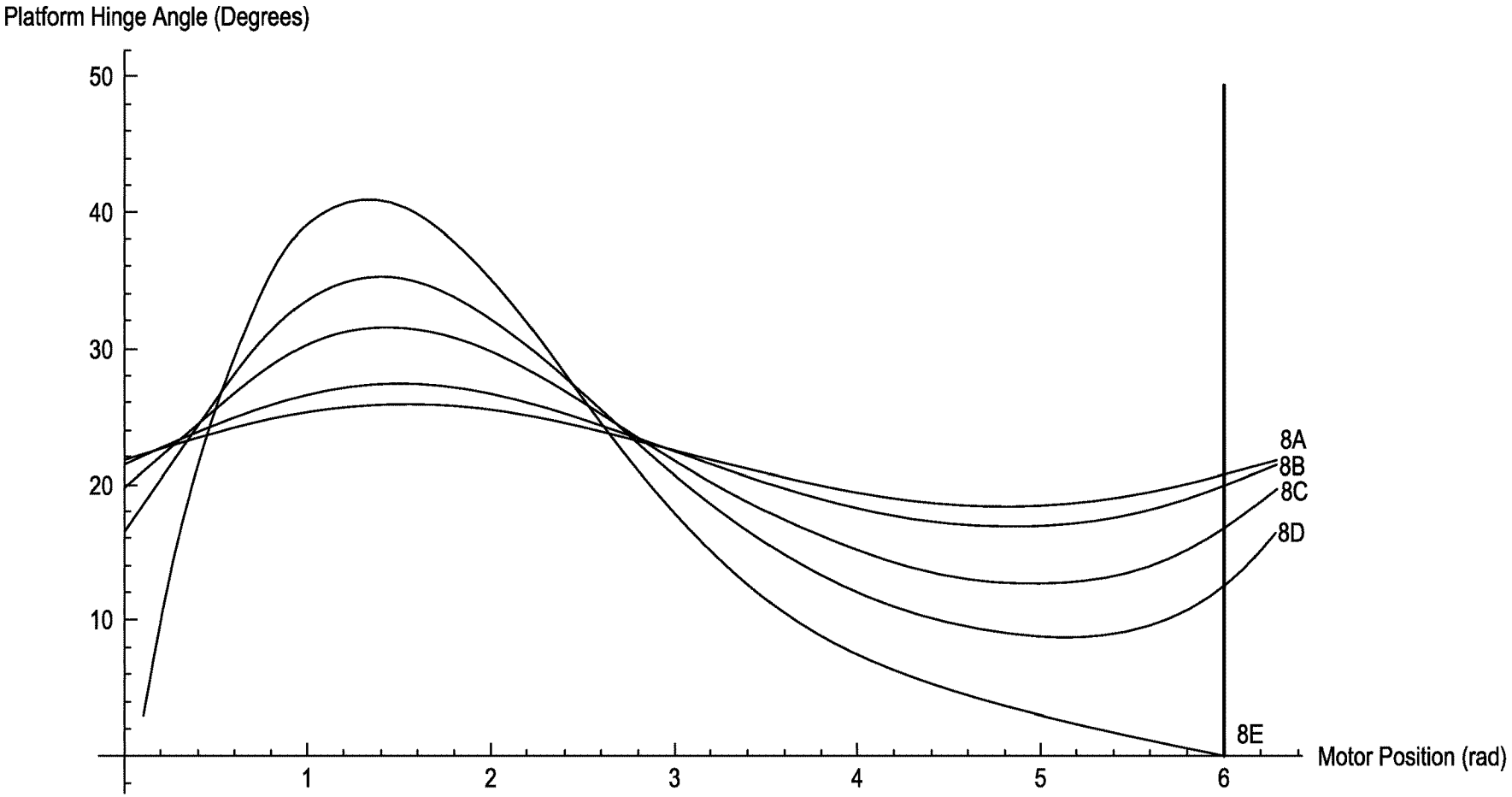
FIG. 8 illustrates various motion patterns based on possible choices of design parameters according to some embodiments.
Figure 9B:
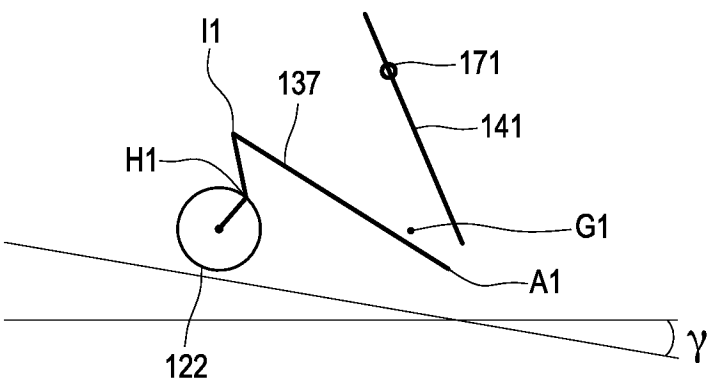
FIGS. 9A-9F illustrate schematic views of a cycle of motion an exercise machine featuring a negative incline, according to some embodiments.
Figure 9A:
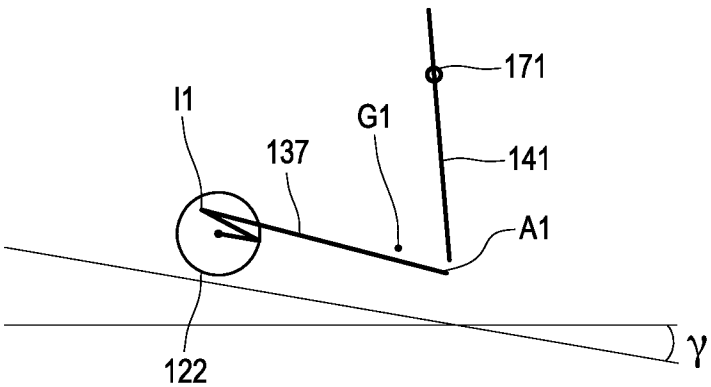
Figure 9D:
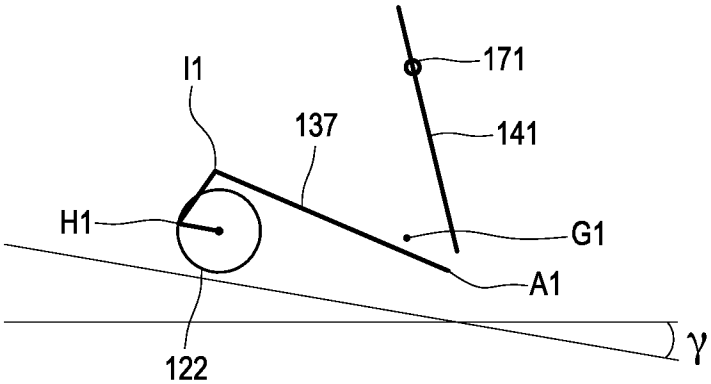
Figure 9C:
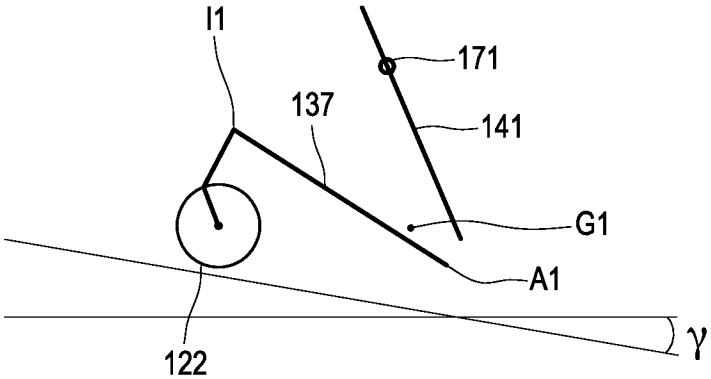
Figure 9F:
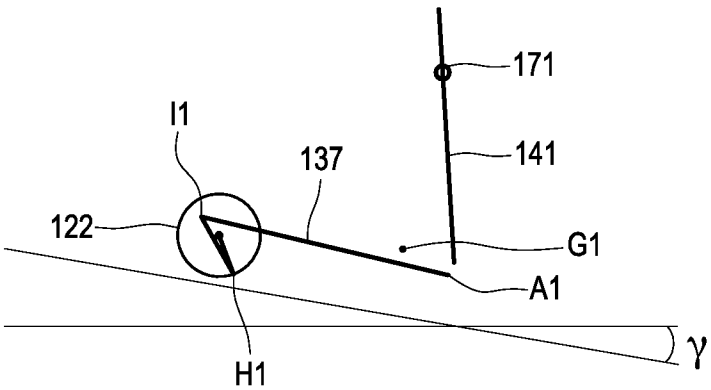
Figure 9E:
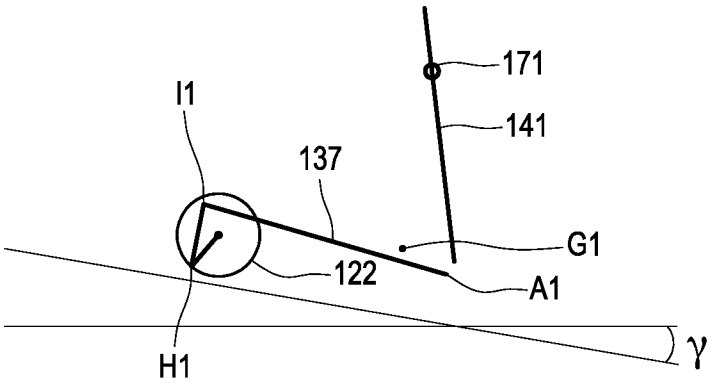
Figure 10B:
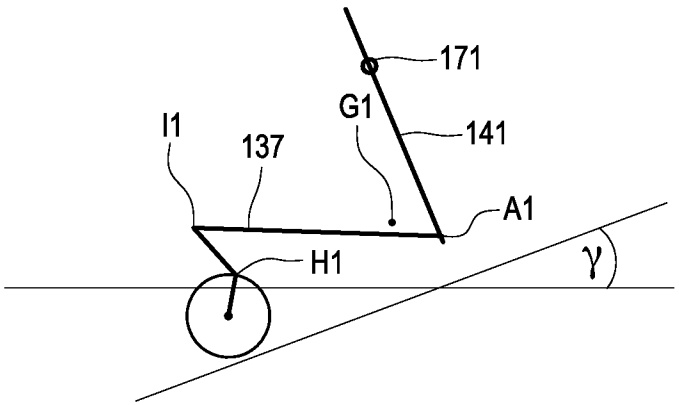
FIGS. 10A-10F illustrate schematic views of a cycle of motion of an exercise machine featuring a positive incline, according to some embodiments.
Figure 10A:
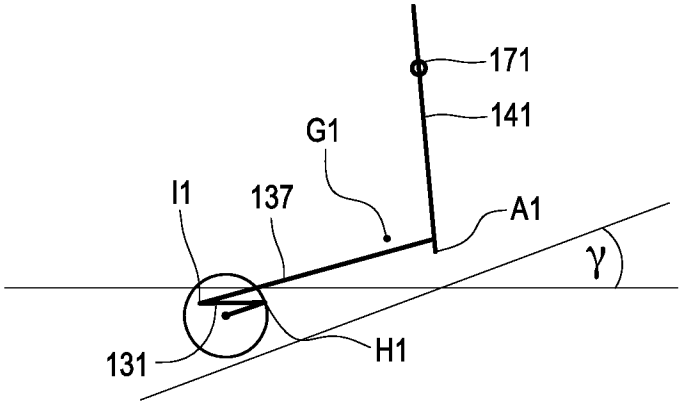
Figure 10D:
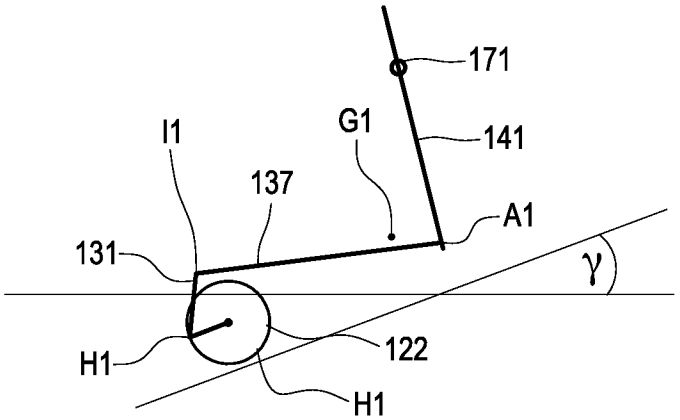
Figure 10C:
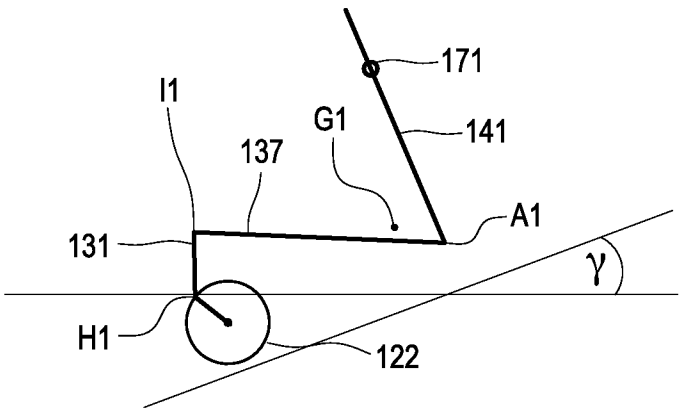
Figure 10F:
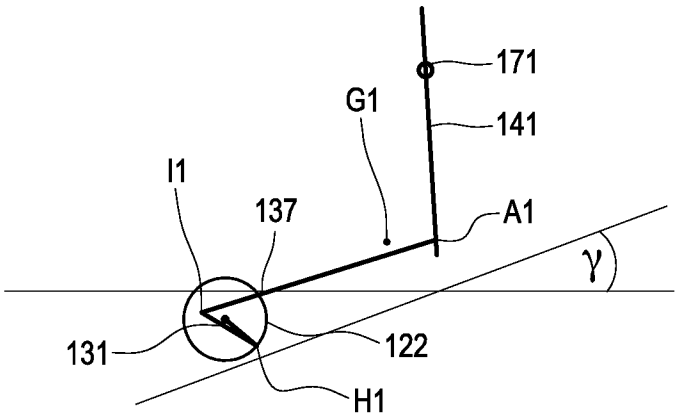
Figure 10E:
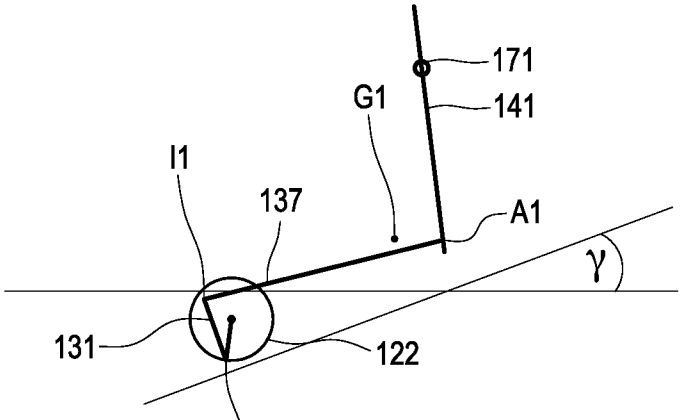

The ratio of the lengths R of connecting rods 131, 132 to the lengths C of the crank rods 126, 127 determines the amplitude and characteristic of the resulting rotational motion. In some embodiments, R/C may be substantially equal to 1. In some embodiments, R/C may exceed 1; for example, R may exceed C (or at least) by about 5%, by about 10%, by about 15%, by about 20%, by about 25%, by about 30%, by about 35%, about 40%, about 45%, about 50%, or more. In some embodiments, C may exceed R by (or at least) about 5%, by about 10%, by about 15%, by about 20%, by about 25% or by about 30% or more; an additional degree of freedom may be present in the system so as to allow a full cycle of rotation such as, for example, to allow the platform arms to telescope relative to the platform hinges A1, A2. The relationship between R and C and the movement of the platform arms 135, 136 can be non-linear and complex. An example of the movement of the platform hinge for different choices of R and C is shown in FIG. 8. Increasing R/C while keeping other parameters constant will, in some embodiments, decrease the amplitude of the motion on the platform arms 135, 136. Practically feasible values for R and C may be limited by physical constraints on the volume swept by the rotating mechanism. FIG. 8 illustrates a decreasing R/C and associated increase in amplitude of the motion of the platform arms 135, 136 from lines A to E.

As illustrated, the platform arms 135, 136 are connected through one of the damping shock absorbers or dampeners 133, 134 to the cantilever 110. The damping shock absorbers 133, 134 may be hydraulic shock absorbers, each comprising, for example, a spring-loaded piston moving in a cylinder filled with damping fluid, dimensioned, and preloaded so that they remain within their available range of travel during a cycle of the machine 101. The cantilever 110 is rigidly connected to the steel frame 104. The damping shock absorbers 133, 134 also help smooth the motions of the machine 101, in particular when the crank rods 126, 127 pass the top-dead center or bottom-dead center positions.

In some embodiments, the handle arms 141, 142 are rigid poles or cylinders with hand grips attached near their top ends. For example, handle arms 141, 142 may have tubular hand grips 177, 178 or hand grip grids 303, 304. Irrespective of which type of hand grip is used, the hand grips may be rotatably attached to a pivot on handle arms 141, 142, so as to allow the hand grips to rotate along circular trajectories 25, 26. Alternatively, the hand grips, e.g. tubular hand grips 177, 178, or hand grip grids 303, 304, may be rigidly attached to handle arms 141, 142.

Figure 1B:
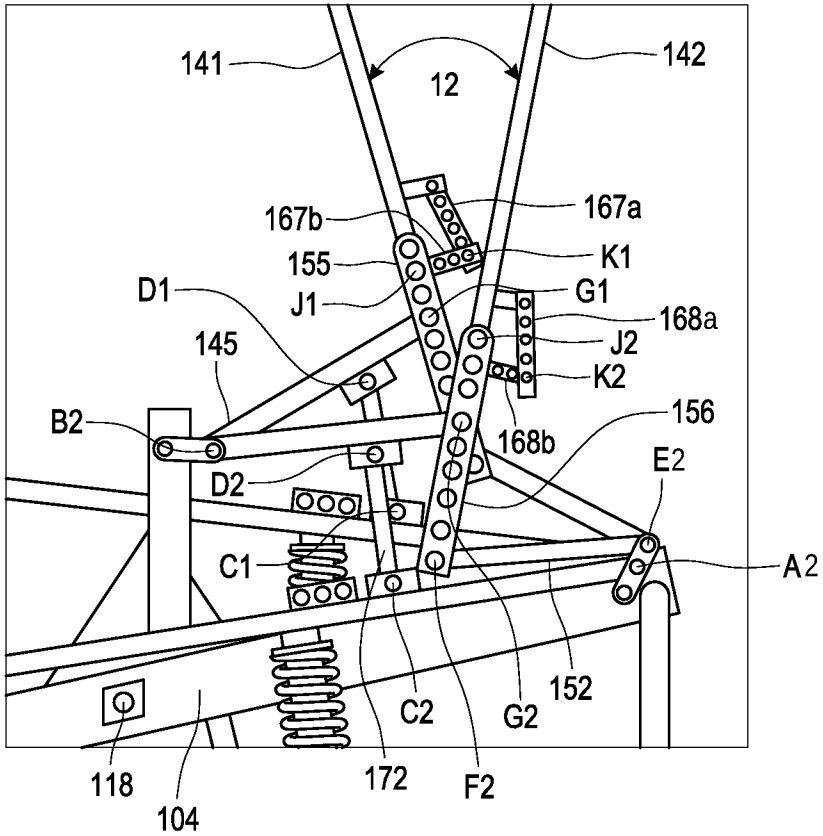
FIG. 1B illustrates a detail view of the linkages of an exercise machine according to some embodiments.

To transfer the motion from the platform arms 135, 136, to the handle arms 141, 142, a linkage is used, which is shown enlarged and in greater detail in FIG. 1B. The arm linkage mechanism illustrated in FIG. 1B can include lower control arms 151, 152 and upper control arms 145, 146 to constrain the motion of the handle arms 141, 142 to an angular range of motion 12 with one degree of freedom. The handle arms 141, 142 can be linked to, and driven by the platform arms 135, 136 within the angular range of motion 12 using platform brackets 171, 172 and lever brackets 155, 156. The lower control arms 151, 152 can be rigid joints that, at their front ends, are rotatably connected to the frame 104 via control arm hinges E1, E2.

In some embodiments, the lever brackets 155, 156 are rigid, perforated metal brackets providing openings throughout their entire lengths. The connection between lower control arms 151, 152 and lever brackets 155, 156 can be made by, for example, a threaded bolt mating with one of the openings in lever brackets 155, 156 and affixed by torquing a nut on the opposite side. A shim may be provided between the bolt and the nut to decrease mechanical wear of the contact areas.

To set a fixed angle between the handle arms 141, 142 and the lever brackets 155, 156, two separate connections can be made between the handle arms 141, 142 and the lever brackets 155, 156. First, handle arm connections J1, J2 are made by, for example, a bolt passing through openings in handle arms 141, 142 and openings in lever brackets 155, 156, and secured by a nut. Second, handle arm connections K1, K2 can be made via lower link brackets 167*b*, 168*b* attached to lever brackets 155, 156, and upper link brackets 167*a* and 168*a* attached to handle arms 141, 142. Lower link brackets 167*b*, 168*b*, and upper link brackets 167*a*, 168*a*, can be rigid, perforated metal brackets providing openings throughout their entire lengths. Lower link brackets 167*a*, 168*a* and upper link brackets 167*b*, 168*b* may be connected with a bolt and nut.

By appropriately selecting the attachment points between lever brackets 155, 156 and handle arms 141, 142, the handle arms 141, 142 may be adjusted on a vertical axis, e.g. to accommodate users of different height or to accommodate different desired exercise position. For example, if it is desired to configure the handle arms 141, 142 to extend farther upwards, e.g., to accommodate a larger user, the first handle arm connections J1, J2 can be made at a point higher up on the lever brackets 155, 156 by selecting for the handle arms 141, 142. Conversely, if lower extension of the handle arms 141, 142 is desired, the first handle arm connection J1, J2 can be made at a point lower on the lever brackets 155, 156.

By appropriately configuring second handle arm connections K1, K2 through selection of an appropriate attachment point between upper link brackets 167*a*, 168*a* and lower link brackets 167*b*, 168*b*, the angle between the lever brackets 155, 156 and the handle arms 141, 142 can be configured. For example, the handle arms 141, 142 may be arranged as straight extensions of the lever brackets 155, 156 (as illustrated), to angle off towards the user, or to angle off away from the user, by appropriate choice of the attachment points between the upper link brackets 167*a*, 168*a* and lower link brackets 167*b*, 168*b*.

The lever brackets 155, 156 are connected with, for example, via a bolt and nut to the upper control arms 145, 146. As illustrated, each of the upper control arms 145, 146 is rotatably connected to the support tower 106 and thus to the frame 104 via tower hinges B1, B2. The attachment points between the lever brackets 155, 156 and the upper control arms 145, 146 are the fulcrum hinges G1, G2. The fulcrum hinges G1, G2 are the fulcra of a lever mechanism moving the handle arms 141, 142. The range of travel of the lever brackets 155, 156, and thus of the handle arms 141, 142, can thus be configured by appropriately selecting the position of the fulcrum hinges G1, G2. When a larger range of travel is desired, the fulcrum hinges G1, G2 can be configured to be closer to the handle arm hinges F1, F2, thus elongating the output arm of the lever mechanism. Conversely, where a smaller range of travel is desired, the fulcrum hinges G1, G2, can be moved further away from the handle arm hinges F1, F2, thus shortening the output arm and reducing its range of travel.

As illustrated, the platform brackets 171, 172 connect the platform arms 135, 136 to the upper control arms 145, 146. A rotatable connection between platform brackets 171, 172 and platform arms 135, 136 can be made at platform arm link hinges C1, C2. A rotatable connection between upper control arms 145, 146 and platform brackets 171, 172 can be made at control arm link hinges D1, D2. Platform brackets 171, 172 will thus impart a push-pull motion on the upper control arms 145, 146 as the platform arms 135, 136 move.

As discussed, in some embodiments, several parameters of the platform arms 135, 136 can be configured so as to adapt the machine 101 to induce different desired upper body postures of the user. It will also be appreciated that the relative phase between the movement of handle arms 141, 142 and platform arms 135, 136 can be changed by appropriately configuring the linkage mechanism. For example, the handle arms 141, 142 can be configured to move opposite to the platform arms 135, 136 by modifying the lever mechanism formed by lever brackets 155, 156, e.g. by moving the fulcrum hinges G1, G2 below the handle arm hinges F1, F2.

The user may place each foot on one of the foot stands 137, 138 attached to platform arms 135, 136. The user may be able to configure the range of motion differently by changing his or her foot position on foot stands 137, 138 on the platform arms 135, 136. For example, the user may choose to increase the vertical range of motion during a cycle of the machine 101 by moving on the foot stands 137, 138 closer to the sprocket crank 122 as illustrated in FIG.

1E. Alternatively, the user may choose to decrease the vertical range of motion by moving on the foot stands 137, 138 further away from the sprocket crank 122 as illustrated in FIG. 1D. After adjusting the user's position on the foot stands 137, 138, it may be desirable to also appropriately reconfigure upper link brackets 167*a*, 168*a* and lower link brackets 167*a*, 168*a* so as to allow the user in the newly selected foot position to comfortably reach tubular hand grips 177, 178.

Figure 3:
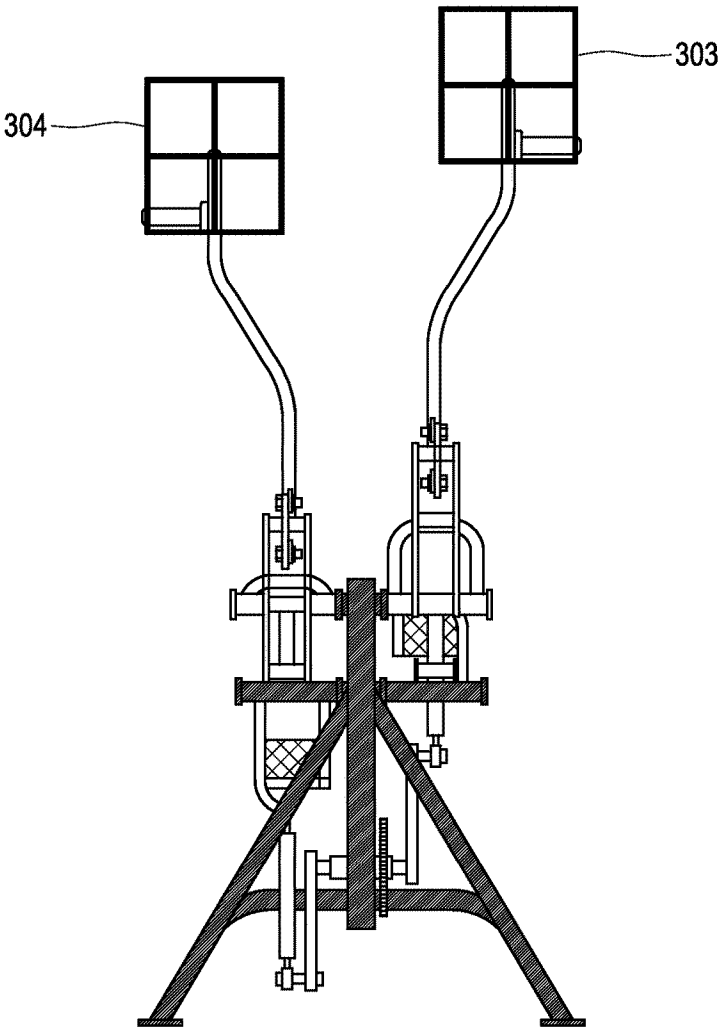
FIG. 3 illustrates a front view of an exercise machine with a hand grip system according to some embodiments.
Figure 4:
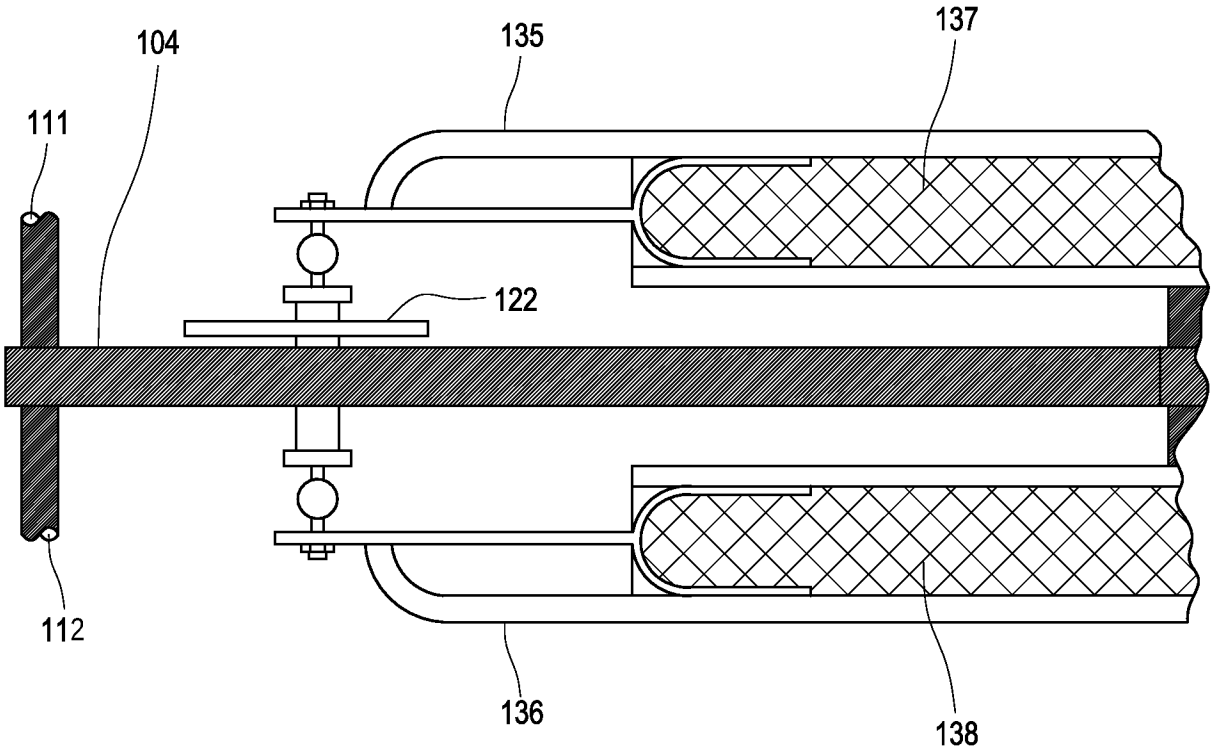
FIG. 4 illustrates a partial top view of an exercise machine according to some embodiments.

The user may utilize handle arms 141, 142 depending on personal preference, the user's stability needs, and the goal of the exercise, for example by placing his hands on the handle arms 141, 142. For example, the user may grab the handle arms 141, 142 directly, or may use hand grips. The hand grips may be tubular hand grips 177, 178 that extend distally from the handle arms 141, 142. Alternatively, the hand grips may be interconnected structures, such as hand grip grids 303, 304 as illustrated in FIG. 3 that allow for different grip techniques and positions. As discussed, the tubular hand grips 177, 178, or hand grip grids 303, 304, may be rotatably attached to handle arms 141, 142 so as to allow for the user's hand to rotate relative to the handle arms 141, 142. The hand grip grids 303, 304 may extend their grid structure in two or all three dimensions. Advantageously, such a design allows the user to utilize different gripping techniques and thus prevents the exercise from becoming repetitive, and allows the user to exercise various hand and arm muscles by resisting or anticipating the machine's motion.

Figure 1C:
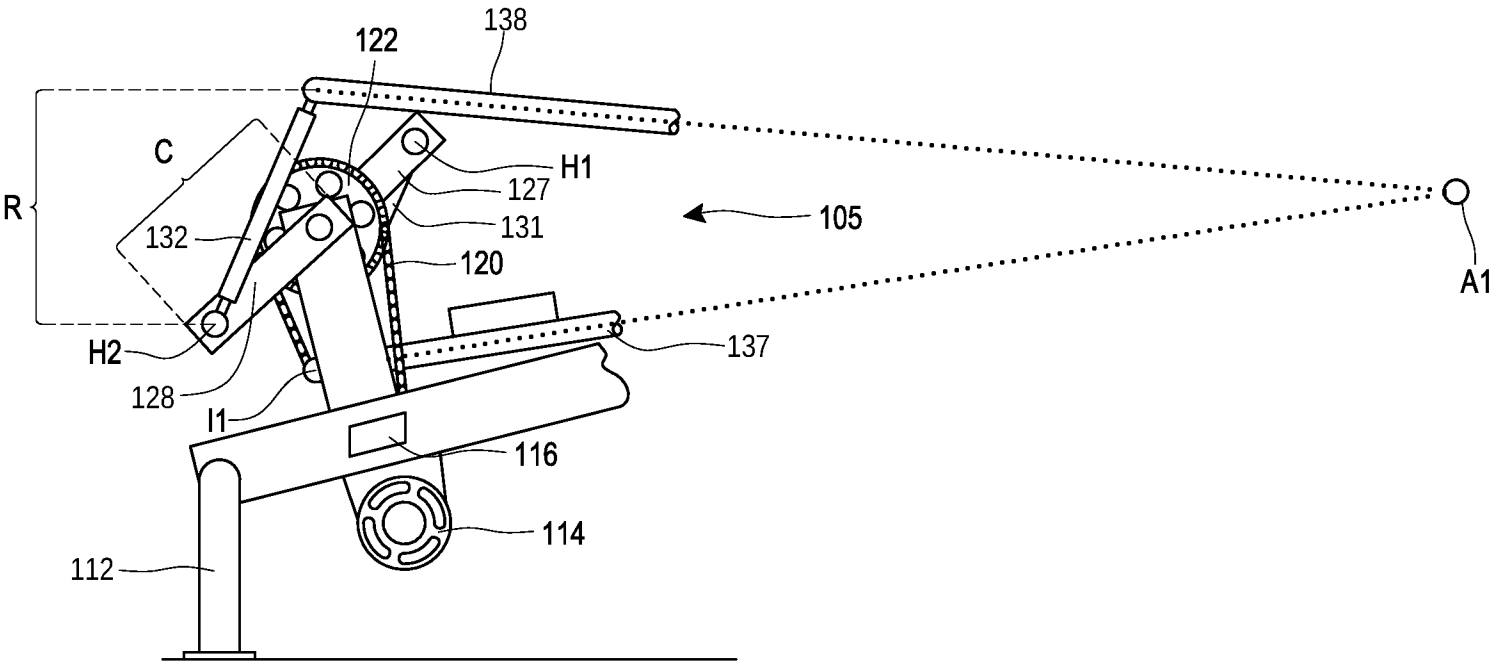
FIG. 1C illustrates a detail view of a crank mechanism according to some embodiments.
Figure 1D:
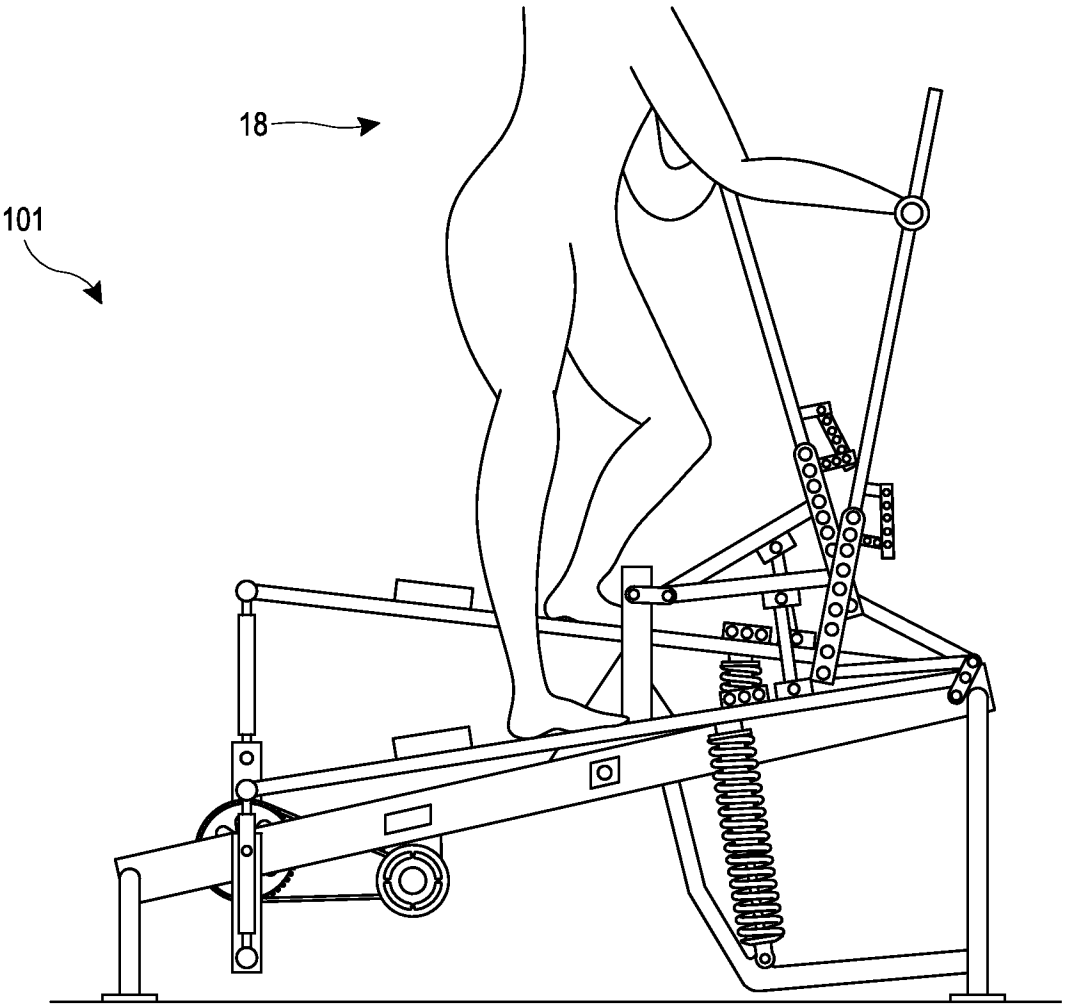
FIG. 1D illustrates a side view of an exercise machine with a user in a relatively upright position according to some embodiments.

FIG. 1C illustrates a crank assembly 105 according to some embodiments. It will be appreciated that, unlike the crank assembly illustrated in FIG. 1A the volume swept by the crank rods 127, 128 and connecting rods 131, 132 does not substantially extend behind the machine. As illustrated, the sprocket crank 122's axis of rotation is substantially level with the axis of rotation of platform hinges A1, A2. The arrangement illustrated in FIG. 1C allows for configuring the range of motion of platform arms 135, 136 and specifically, allows adjusting or biasing the inclination of the platform arms 135, 136 as desired. For example, by raising sprocket crank 122 above platform hinges A1, A2, the motion of platform arms 135, 136 may be negatively biased (e.g., negatively inclined as discussed herein and in particular, as discussed herein in reference to FIGS. 9A-F. Negatively biasing the motion of platform arms 135, 136 may allow for the motion of the platform arms 135, 136 to be similar to the motion of a human walk down negatively sloped terrain and may allow for increased stretching. Conversely, by raising platform hinges A1, A2 above sprocket crank 122, the motion of platform arms 135, 136 may be positively biased. The effects of differently biasing the motion of platform arms 135, 136 is discussed further below with reference to FIGS. 9A-F and 10A-F.

Figure 1E:
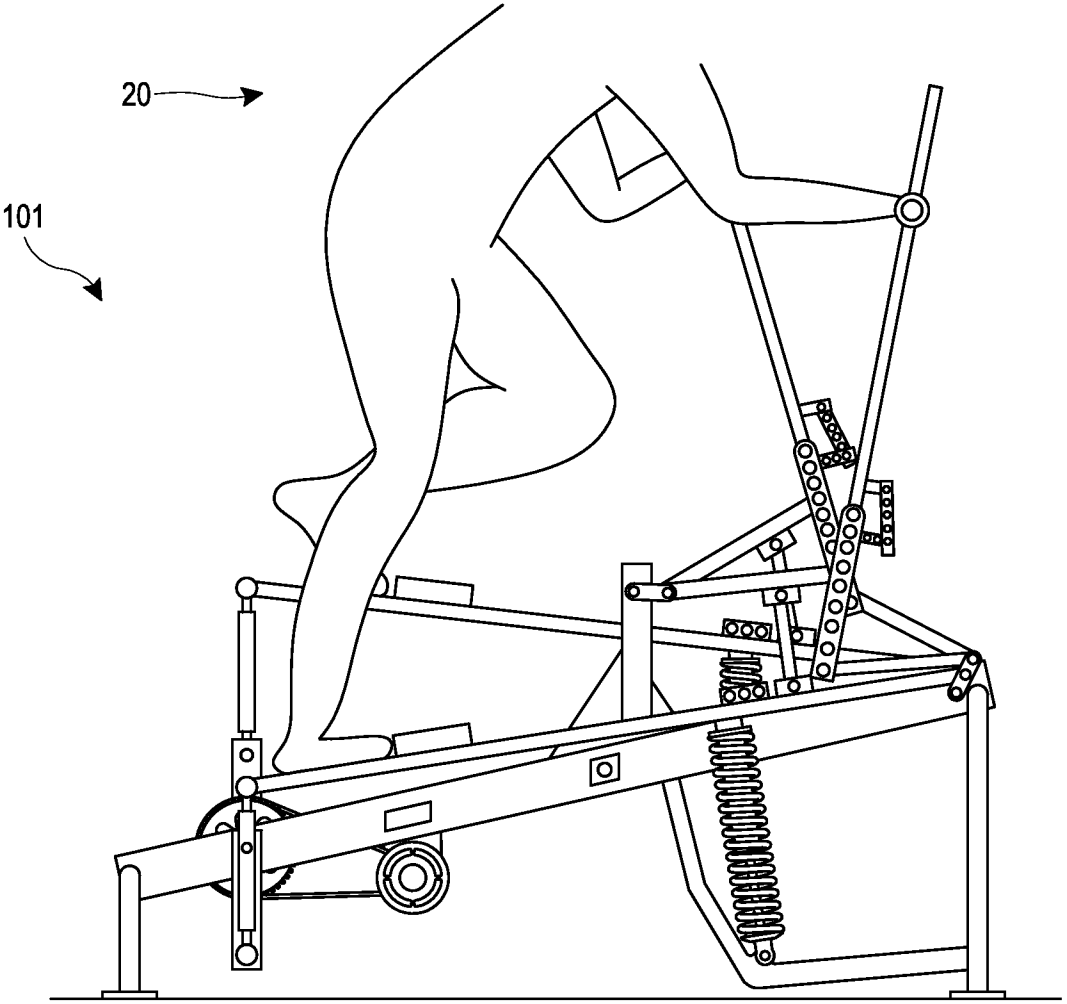
FIG. 1E illustrates a side view of an exercise machine with a user in a relatively cantilevered or athletic position according to some embodiments.
Figure 2:
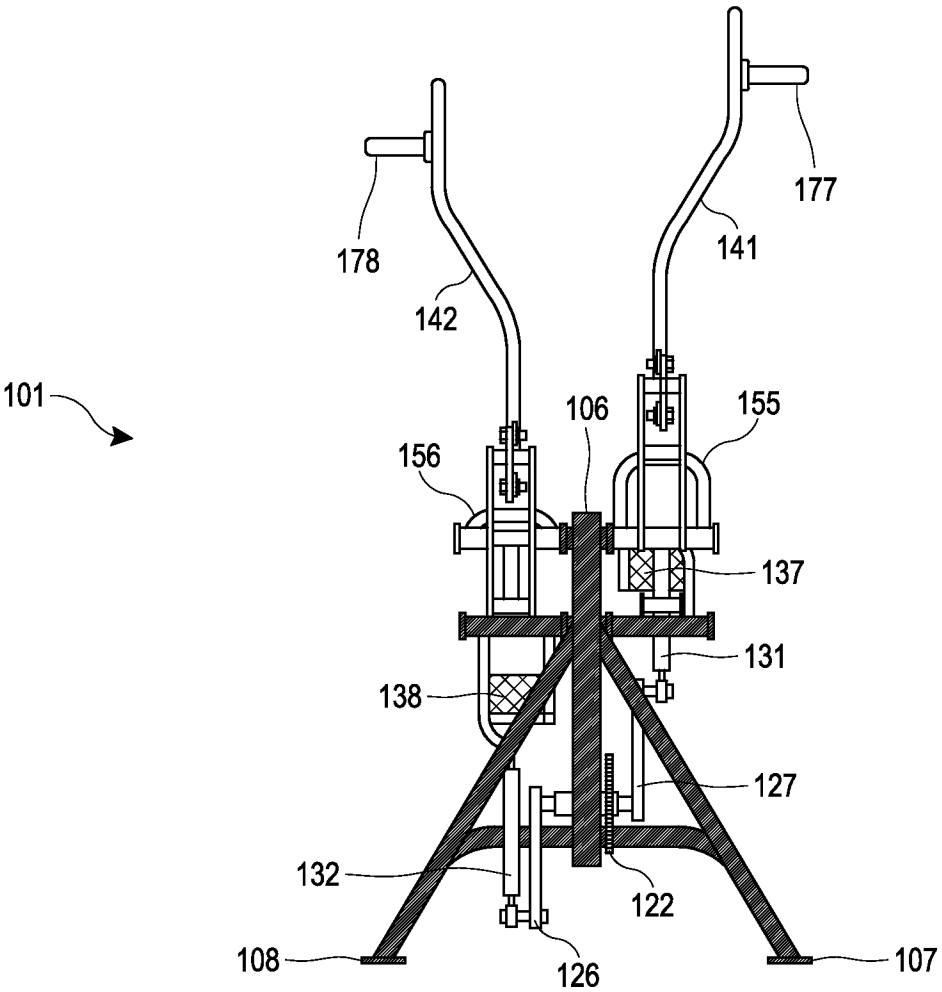
FIG. 2 illustrates a front view of an exercise machine according to some embodiments.

FIG. 1D illustrates a user 18 using an exercise machine 101 in an upright position. The user 18 has limited knee and hand flexion and a substantially straight spine/back that is substantially or relatively vertical. FIG. 1E illustrates a user 20 using an exercise machine 101 according to some embodiments, in a cantilevered or athletic position. The user 20 has substantial knee and hand flexion and a spine/back configuration similar to a deadlift where the back is relatively tilted forward. It will be appreciated that user 18 and user 20 are using the same illustrated exercise machine 101; the user is able to choose a desired posture on the machine 101 by changing where to put the feet on the foot stands 137, 138.

Figure 5:
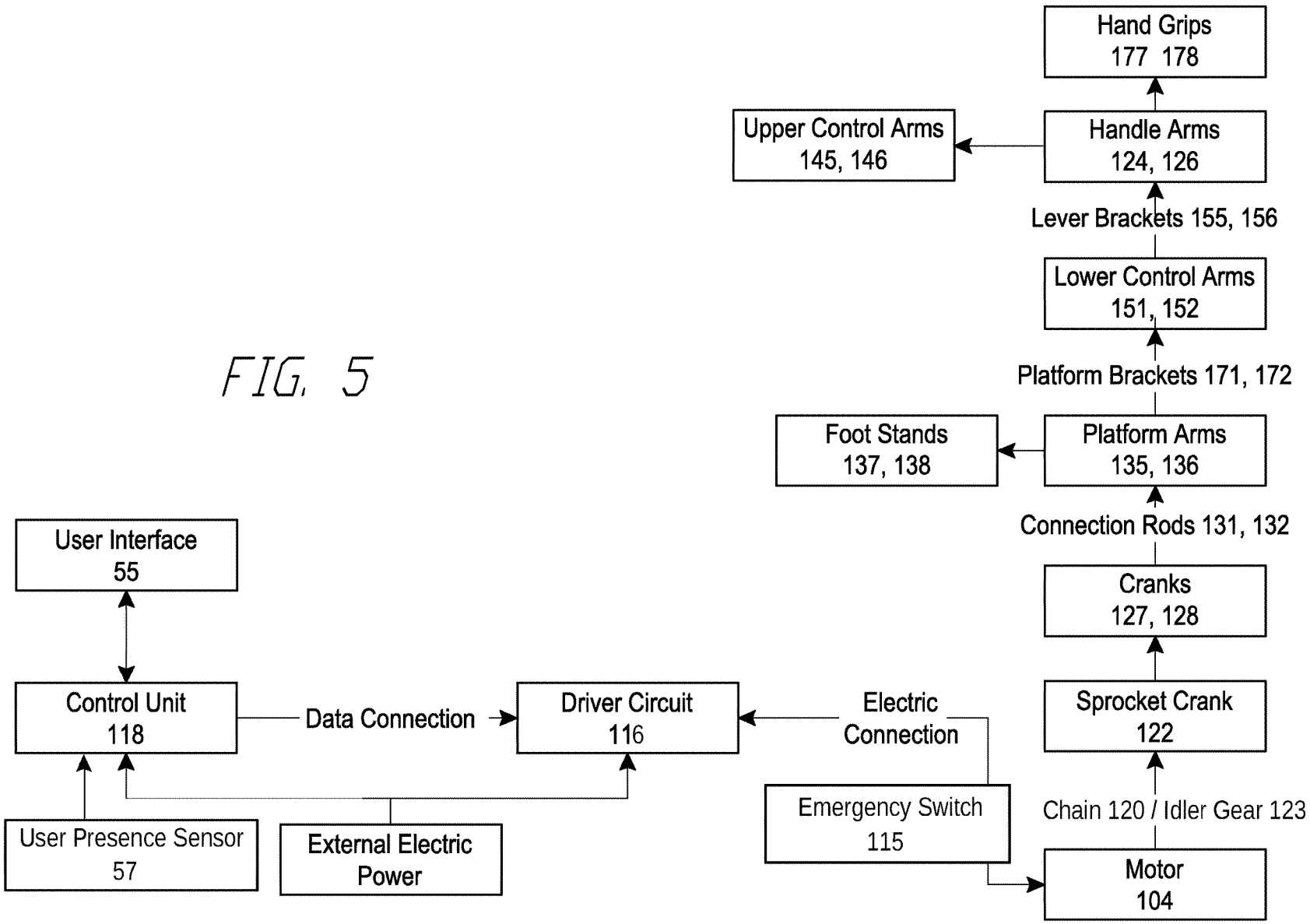
FIG. 5 is a block diagram illustrating a system overview of an exercise machine according to some embodiments.

With reference to FIG. 5, a system overview of, for example, the flow of motive power in an exercise machine according to some embodiments is provided. An external power source, such as a wall outlet, provides electrical power to the motor driver circuit 116 and the control unit 118. The control unit 118 signals the driver circuit 116 the desired motor speed, for example based on user input provided through user interface 55. User interface 55 may be integrated into the control unit 118; for example, user interface 55 may be a rotary knob allowing the user to select a desired speed by turning. Alternatively, user interface 55 may be a graphical user interface (GUI) on a computer screen, such as a touchscreen, that allows the user more elaborate control. For example, user interface 55 may allow the user to program or select a phase-dependent velocity profile. Driver circuit 116 then signals the desired rotational speed to electric motor 114.

In some embodiments, a user interface 55 may be presented via a multi-function display, such as an LCD or AMOLED screen. In some embodiments, a rocker switch or joystick may be provided for the user to navigate user interface 55. In some embodiments, the user interface 55 may provide a touch input facility.

The user interface 55 may further comprise an emergency stop switch 115. Emergency stop switch may interrupt the power to driver circuit 116 and/or electric motor 114. Advantageously, emergency stop switch 115 may cause driver circuit 116 to short-circuit or apply a reverse voltage to electric motor 114 to provide for most effective stopping of the motion of electric motor 114. In some embodiments, the emergency stop switch may be implemented as a fail-safe or dead man's switch; for example, the emergency stop may be a removable device that may be attached (e.g. clasped or worm) to a user's clothing or limbs with a string or strap. When the user moves away, falls off or otherwise moves away from the machine, the string or strap may remove the removable device from the machine, thus, for example, triggering a stop of the machine.

With continued reference to FIG. 5, the motor 114 drives the sprocket crank 122. The crank rods 126, 127 turn with the sprocket crank 122 and move the connecting rods 131, 132, converting the rotational motion into linear motion and transmitting it to the platform arms 135, 136 holding the foot stands 137, 138. The platform arms 135, 136 are connected through platform brackets 171, 172 to the upper control arms 145, 146, which are connected through lever brackets 155, 156 to the handle arms 141, 142. The handle arms 141, 142 are also connected to the frame through lower control arms 151, 152. The pair of forces by the upper control arms 145, 146 and the lower control arms 151, 152 puts the handle arms 141, 142 into a rotational motion, thus moving the tubular hand grips 177, 178.

Figures 6A, 6B, 6C, 6D, 6E, 6F:
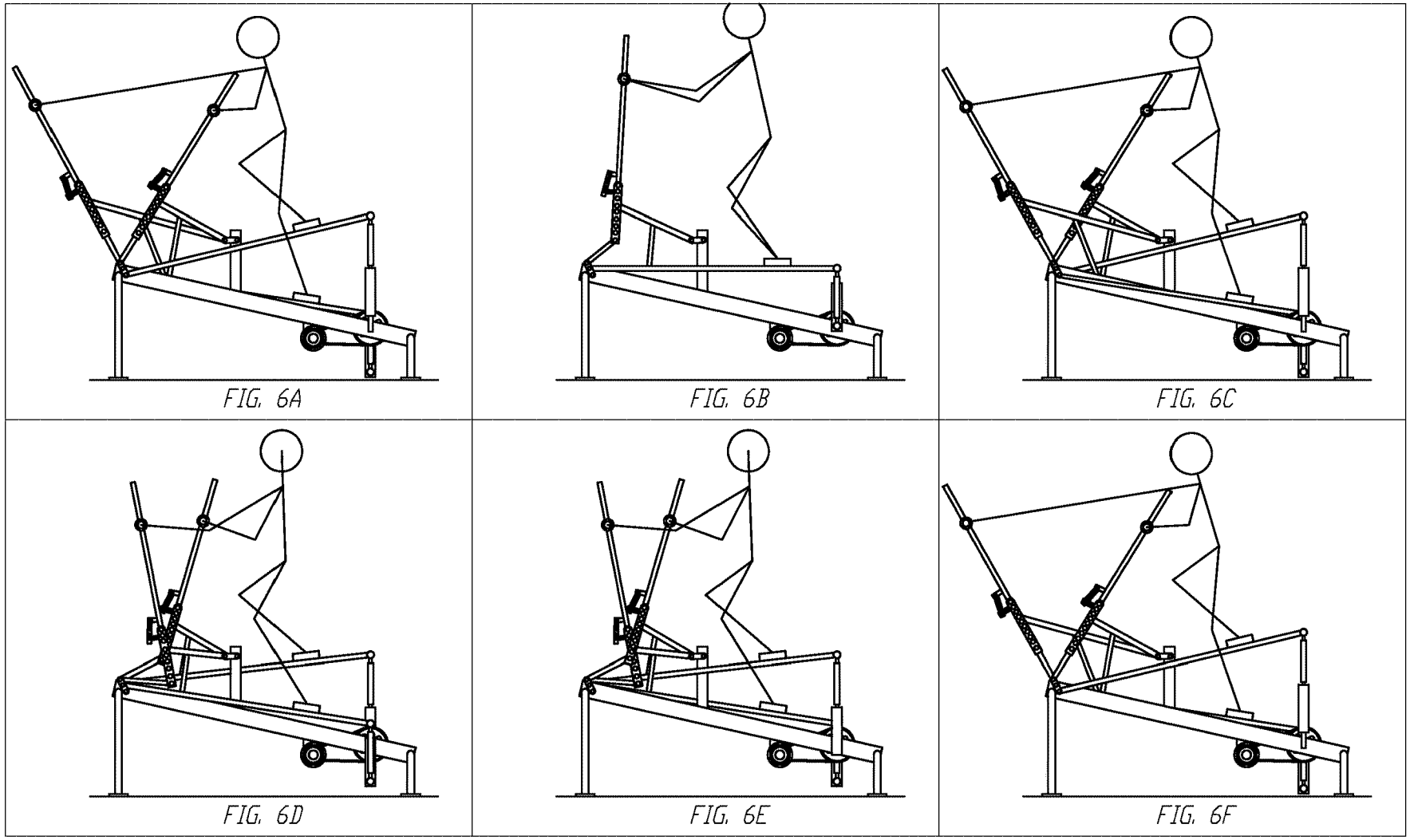
FIGS. 6A-6F illustrate views of a user moving through a cycle of motion on an exercise machine according to some embodiments.

FIGS. 6A-6F illustrate an example exercise machine 101 with a user moving through a full cycle, with each figure representing about 0.2 seconds of time as one example, corresponding to an approximately 50 degree rotation of the sprocket crank 122. FIGS. 6A-6F illustrate movement of the user using the exercise machine 101 along the sagittal plane (e.g., the sagittal plane extending along surface of the page and being viewed perpendicular to the sagittal plane). It will be appreciated that the user's arm and leg motions are substantially limited along one axis and thus may be described by a linear, rather than elliptical, trajectory. In FIG. 6A, the user is in a position with the left arm almost fully flexed and, the left hip and the left knee substantially flexed, while the user's right arm and right leg are substantially extended. In FIG. 6B, both of the user's arms and legs are flexed approximately equally; the user's left arm and left leg are currently undergoing extension, while the user's right leg and right arm are undergoing flexion. In FIG. 6C, the user's right leg and right arm are substantially flexed, whereas the left arm and left leg are substantially extended. In FIG. 6D, the user's right arm and right leg are currently undergoing extension, while the user's left leg and left arm are undergoing flexion. In FIG. 6E, the user's left arm and left leg continue the flexion motion, whereas the user's right leg and right arm continue to extend. In FIG. 6F, the user has returned to substantially the same position as was depicted in FIG. 6A.

Figure 7A:
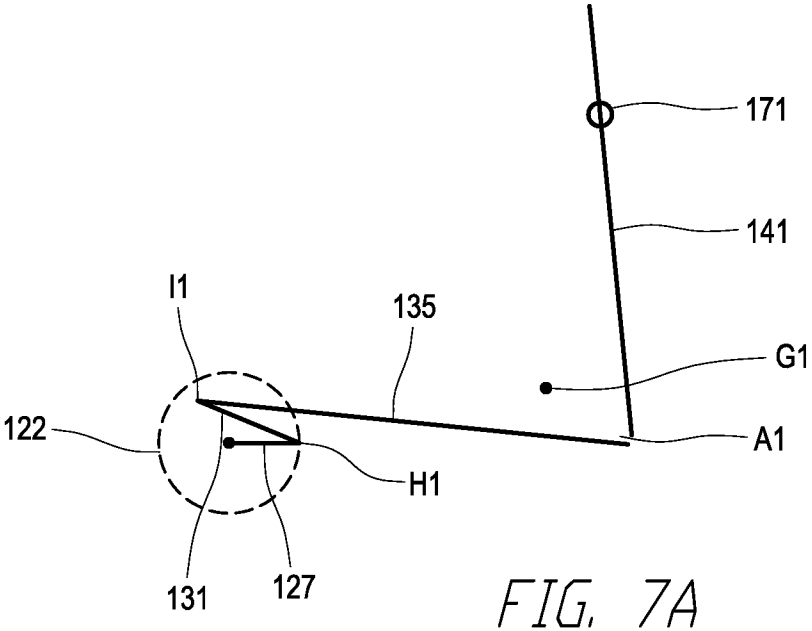
FIGS. 7A-7F illustrate schematic views of the crank mechanism of an exercise machine according to some embodiments.
Figure 7B:
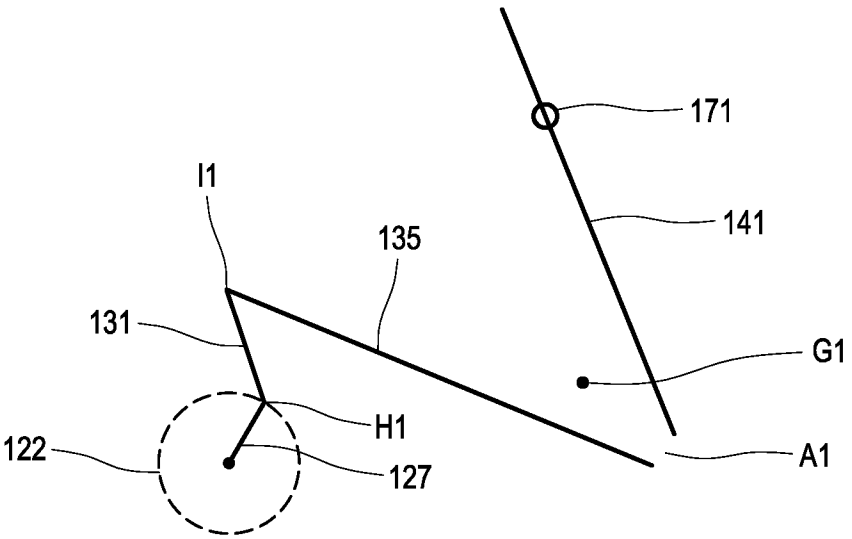

FIGS. 7A-7F illustrate an example exercise machine moving through a cycle of the cranking mechanism, with each figure representing about a 50 degree rotation of the sprocket crank 122 to its adjacent figures. In FIG. 7A, the crank rod 127 has reached a front level position, wherein the foot stands 137, 138 and tubular hand grips 177, 178 are aligned substantially symmetric to each other. Platform arm 135 and hand grip 177 are moving towards the user. FIG. 7B illustrates the crank rod 127 about to pass top-dead center position. In this position, the connecting rod 131 is substantially vertical, so the associated platform arm 135 is in a high position and is still moving towards the user. Simultaneously, hand grip 177 is also moving towards from the user and approaching its closest position to the user. The knee and elbow of a user standing on it will thus be substantially flexed and may experience stretching. It will be appreciated that in the illustrated position, the opposing foot stand is about to pass its bottom-dead center position.

Figure 7D:
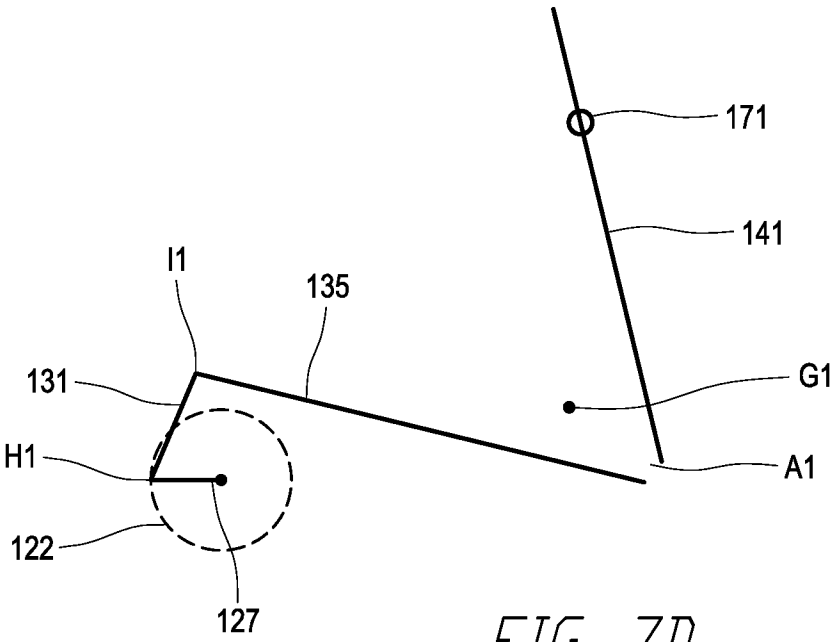
Figure 7C:
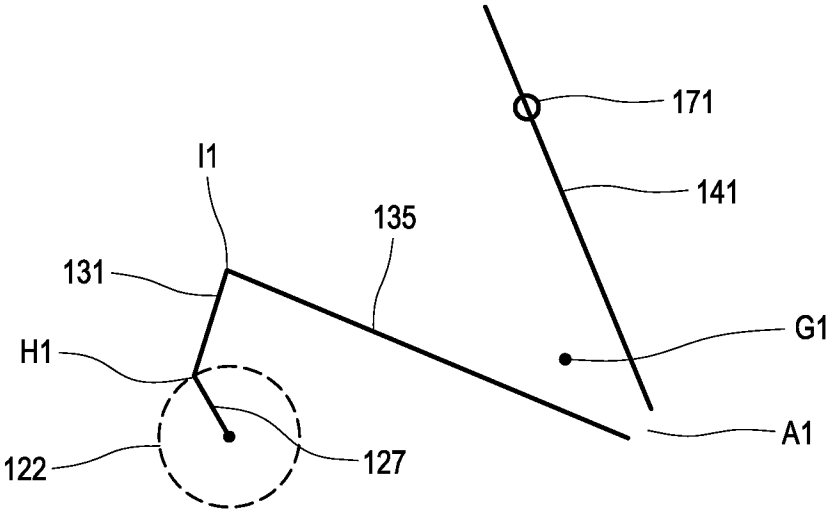
Figure 7E:
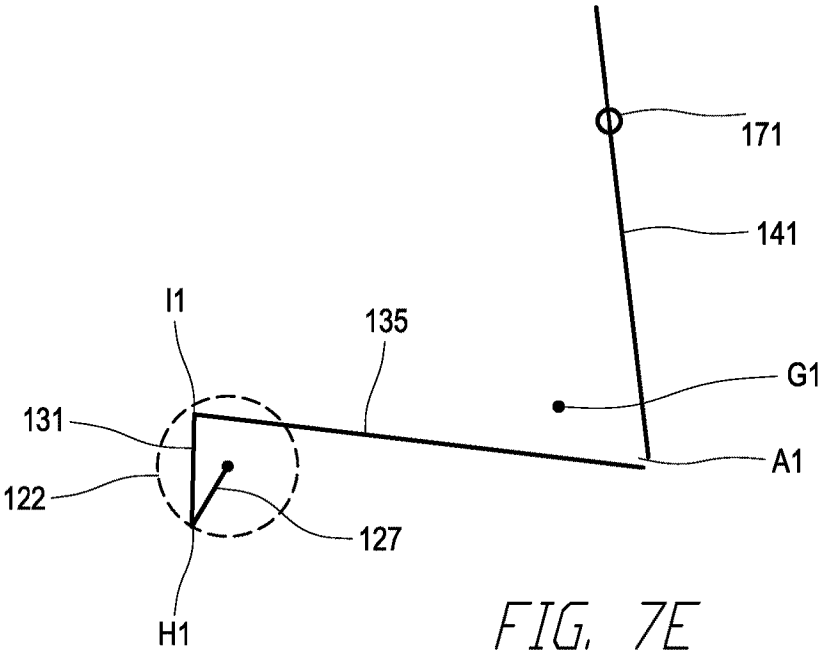
Figure 7F:
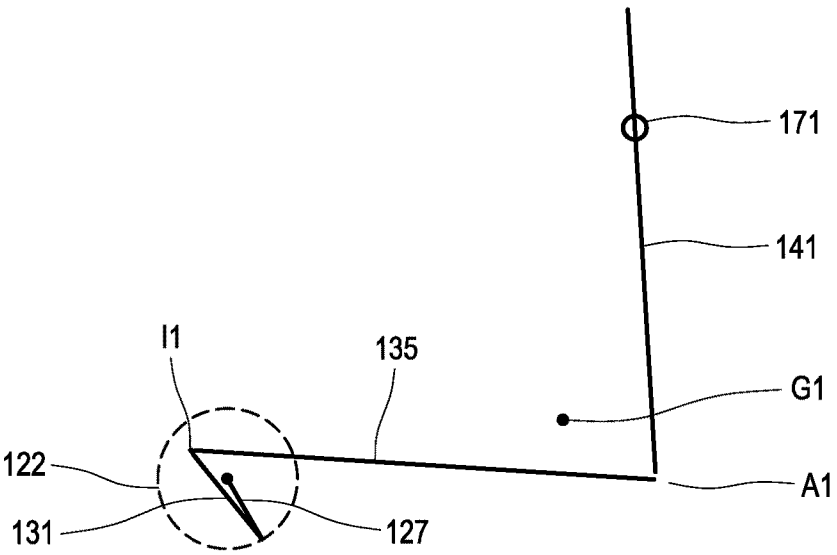

In FIG. 7C, the crank rod 127 has just passed its top-dead center position; both foot stand and hand grip have now reversed their direction of motion and are moving away from the user. The user will thus be in a knee and elbow extension phase of the exercise. In FIG. 7D, the crank rod 127 has reached its back level position, again aligning platform arm 135 with its counterpart on the opposing side of the machine. Platform arm 135 and hand grip 177 are now moving away from the user. In FIG. 7E, the crank rod 127 is just about to reach a bottom-dead center position, wherein it will reverse its motion, bringing both hand grips and platform arms back towards the user. In FIG. 7F, the crank rod 127 has passed its bottom-dead center position and is approaching the position illustrated in FIG. 7A again. It will be appreciated that in the embodiment illustrated, the axes, amplitudes, and phases of the rotation of platform arm 135 and handle arm 141 are advantageously chosen with respect to each other so that the vertical component of the rotation/movement of handle arm 141 is substantially compensated by the vertical component of the rotation/movement of the platform arm 135. This allows the hand grip 177 to be driven in a substantially linear, rather than elliptical, trajectory.

It will be appreciated that the length of the individual linkages can be varied so as to achieve different desired parameters and trajectories. For example, length of crank rod 127 and connecting rod 131 can be varied to determine the amplitude of oscillation of platform arm 135. Sprocket crank 122 may be moved higher or lower with respect to platform hinges A1, A2 to change the inclination of platform arm 135. It will be appreciated that based on the translational rigidity of platform hinges A1, A2, and sprocket crank 122, certain length constraints may need to be satisfied so as to prevent the system from jamming during any point of the cycle.

FIG. 8 illustrates a plot of the movement of platform hinge A1 during a cycle of the exercise machine for different choices of R/C, i.e. the ratio of connecting rods 131, 132 length R to crank rods 126, 127 length C. This was calculated by varying crank rod length C as illustrated in the table below for a scaled version of an exercise machine with a platform arm length P of 200 cm, a distance between platform hinge and shaft of 184 cm, and a connecting rod length R of 75.5 cm.

| Graph | R/C |
|---|---|
| Line 8A | 16.7 |
| Line 8B | 12 |
| Line 8C | 6.66 |
| Line 8D | 4.76 |
| Line 8E | 3.33 |

It will be appreciated that Line 8E is not continuous over the full range of motion. This may be interpreted as the system being over constrained and thus not capable of a full revolution where the system should include another degree of freedom to accommodate the rotational movement of the crank mechanism. Lines 8A-8E show different non-limiting choices for R/C. In some embodiments, it may be advantageous to select an R/C trending closer toward 1 (e.g., about 3.5 to 12) that features a well-pronounced peak, so as to resemble a human walking or bicycling cadence. Alternatively, if a machine with more sinusoidal motion is desired, it may be desirable to select an R/C closer to about 12 to 20, for example as illustrated in Lines 8A and 8B. In some embodiments, the R/C can be between about 3 and about 20, such as about 3, 4, 5, 6, 7, 8, 9, 10, 11, 12, 13, 14, 15, 16, 17, 18, 19, 20, or ranges incorporating any two of the aforementioned values.

The slope of a line on FIG. 8 corresponds to the angular velocity of the platform arms 135, 136 at a given point in the motion cycle. The linear velocity of a point on foot stands 137, 138 (e.g. the user's feet in a given position) is given by the distance between the point on foot stands 137, 138 and the platform hinges A1, A2, multiplied by the angular velocity of platform arms 135, 136. As such, it will be appreciated that the linear velocity of a point on foot stands 137, 138 during a given phase of the cycle can be configured by appropriately adjusting R/C.

With reference to FIGS. 9A-9F and 10A-10F, it will be appreciated that various modifications can be made to incorporate a negative or a positive bias of the incline of the platform arms 135, 136. For example, a portion of the crank mechanism and/or platform arms 135, 136 may be connected to a hydraulic system incorporated into or attached to the frame 104 that raises or lowers certain portions or components of the machine 101. In FIGS. 9A-9F, sprocket crank 122 has been inclined by a negative angle φ downwards relative to the horizon or ground/support surface to provide a negative incline. A negative angle φ downwards can facilitate positioning the user in an athletic posture as illustrated herein, for example, with reference to FIGS. 13A-13C. Using a negative incline may induce a forward lean, and thus more intensely engage the user's abdominals. In FIG. 10A-10F, sprocket crank 122 has been inclined by a positive angle φ upwards relative to the horizon or ground/support surface. A positive angle φ upwards can facilitate positioning the user in an upright posture discussed, for example, with reference to FIGS. 1D and 1E. A positive incline may induce the user to stabilize himself or herself with a pull-back motion on the arm hand grips 177, 178, thus more intensely engaging the user's back muscles and muscles such as the biceps and latissimus dorsi.

Figure 11:
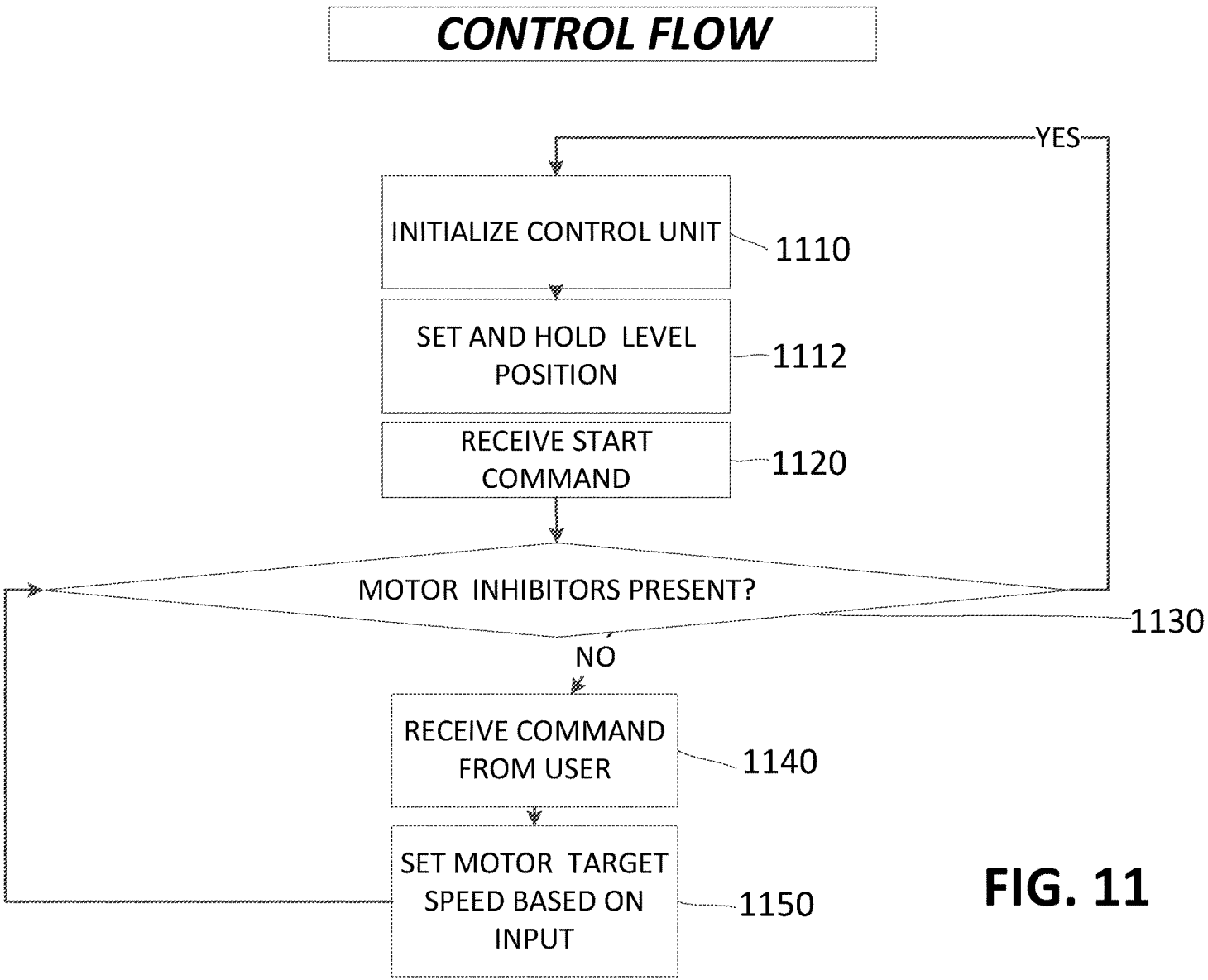
FIG. 11 illustrates an example program flow in the control logic of an exercise machine, according to some embodiments.

FIG. 11 illustrates an example control flow, such as may be performed within or by control unit 118. In block 1110, control unit 118 is initialized, for example when power is first applied to the machine via a power switch and/or user presence sensor 57 as discussed herein. Block 1110 may include a self-test of various components, including driver circuit 116 and control unit 118.

In block 1112, control unit 118 may control driver circuit 116 to move the machine towards a level position and hold the position. Advantageously, this position may allow the user to enter and exit the machine more easily, e.g. because the machine remains substantially stable while the user shifts his weight onto the machine and because the user can step on the machine's platform arms 135, 136 in a substantially level position (e.g. similar to climbing a stair).

In block 1120, a start request may be received from a user via user interface 55.

In block 1130, the control unit 118 may check for various run inhibitors. Run inhibitors may include a stop request received from the user via user interface 55 (e.g. a press of a stop button), a failure of user presence sensor 57 to detect a user's presence, motor stall, overspeed, overtemperature or other failure of electric motor 114 or driver circuit 116. Advantageously, this may prevent the machine from operating in potentially unsafe conditions, such as when no user is detected, thus preventing an unattended machine from striking surrounding persons or objects and causing unnecessary mechanical wear.

If no inhibitors are present, the system may proceed to block 1140. If at least one inhibitor is present, the system may return to block 1110.

In block 1140, a command may be received from the user, e.g. via user interface 56. The command may include a request to increase or decrease the rotational speed of electric motor 114, including a request to pause the machine (e.g. reduce the rotational speed of electric motor 114 to zero), and a request to unpause the machine (e.g. return to a previously selected rotational speed of electric motor 114).

In block 1150, control unit 118 may configure driver circuit 116 to set the requested rotational speed. Advantageously, control unit 118 may limit the rate of change or angular acceleration and/or deceleration of electric motor 114, so as to reduce the risk of the user from being surprised, frightened or thrown off balance by a sudden jerk in the machine's motion.

For example, control unit 118 may gradually bring the target speed closer to the requested speed received in block 1140 based on an interpolation formula, such as linear interpolation or cubic interpolation. After the new speed has been set, control unit 118 may return to block 1130. Advantageously, if a request to pause the machine is received, the current rotational speed of electric motor 114 may be stored before the speed is reduced. This may allow the user to resume exercising with the speed previously set. After the machine has been paused, control unit 118 may gradually increase and/or impose a limit on the speed at which the machine resumes to reduce the risk of the user becoming surprised, frightened or thrown off balance by sudden acceleration.

Figure 12A:
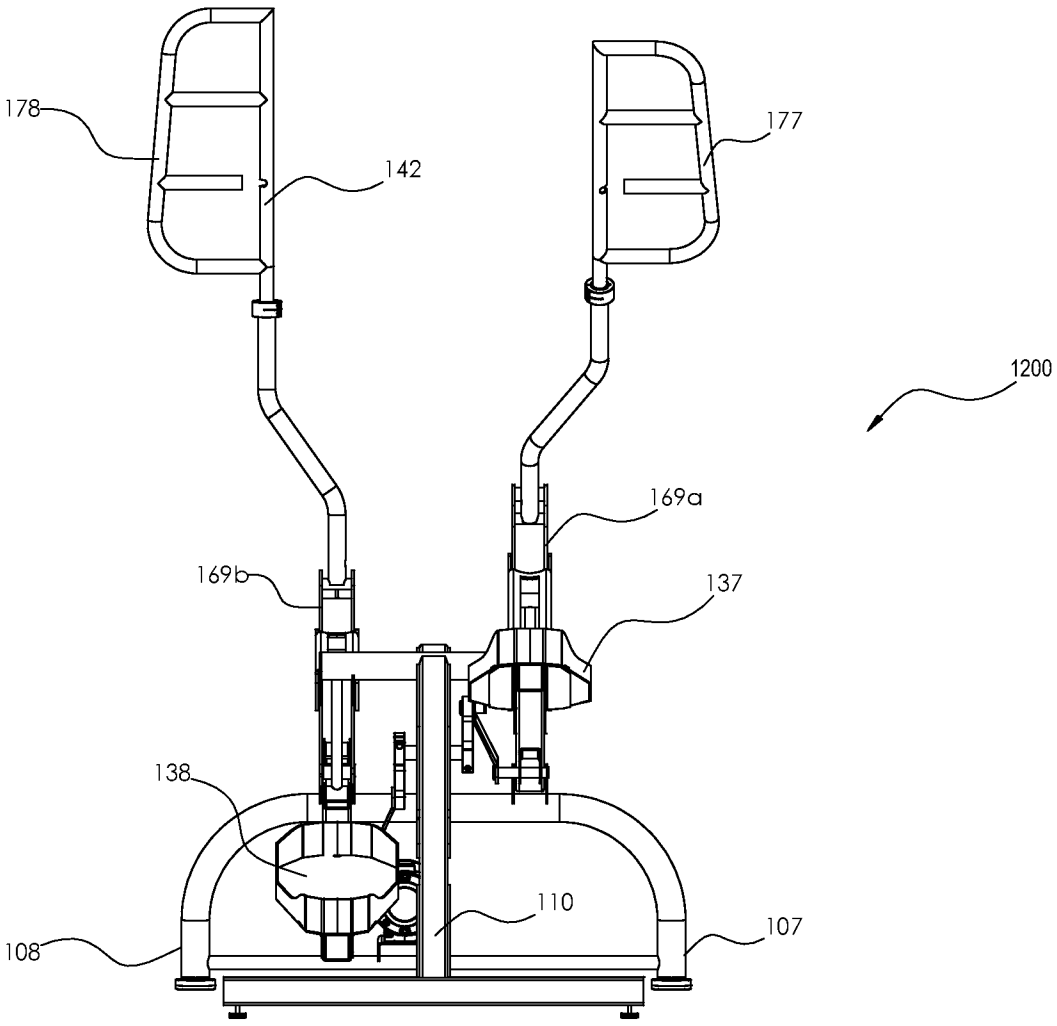
FIGS. 12A, 12B and 12C illustrate a front, side and perspective view, respectively, of an exercise machine according to some embodiments.
Figure 12B:
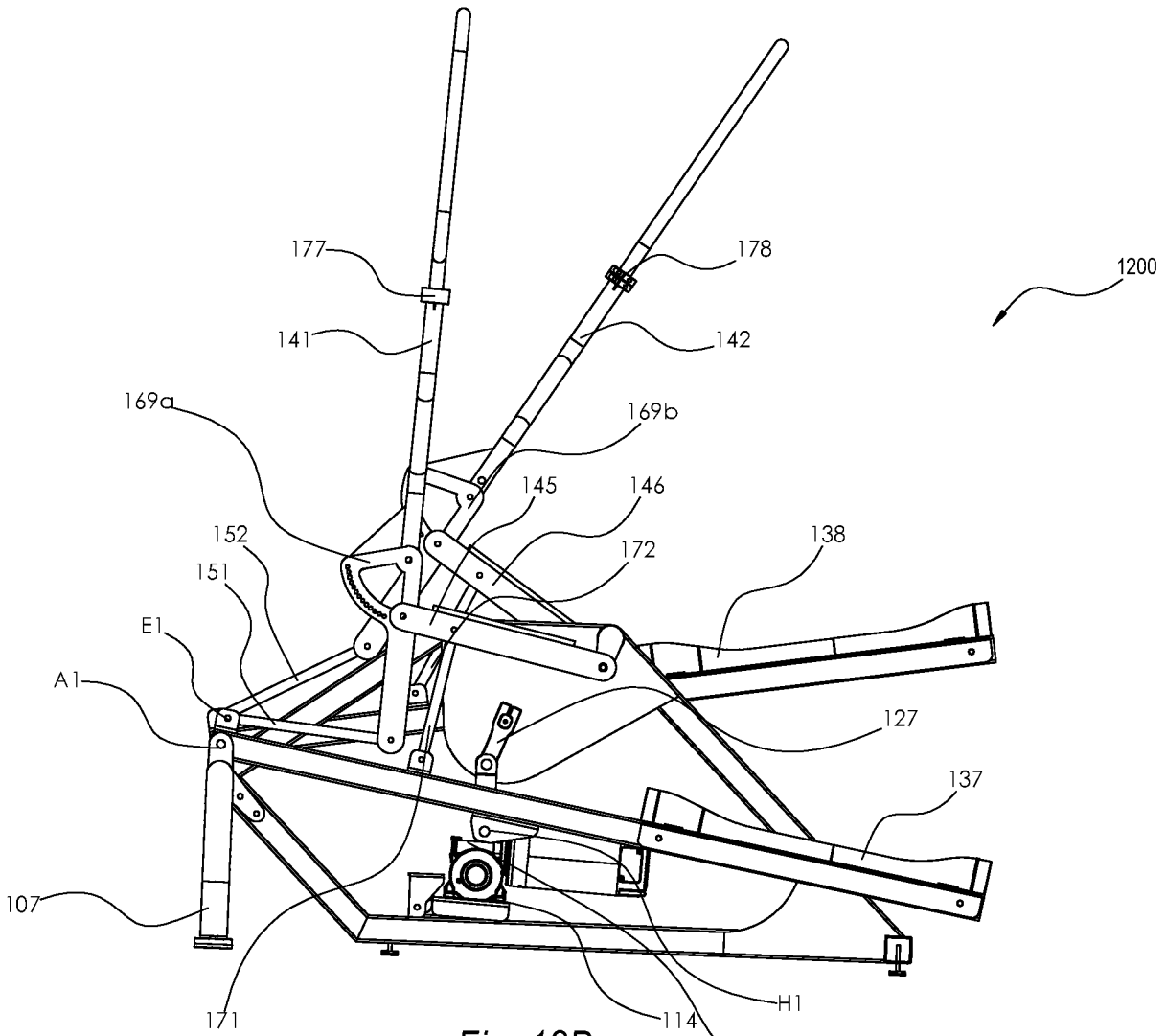
Figure 12C:
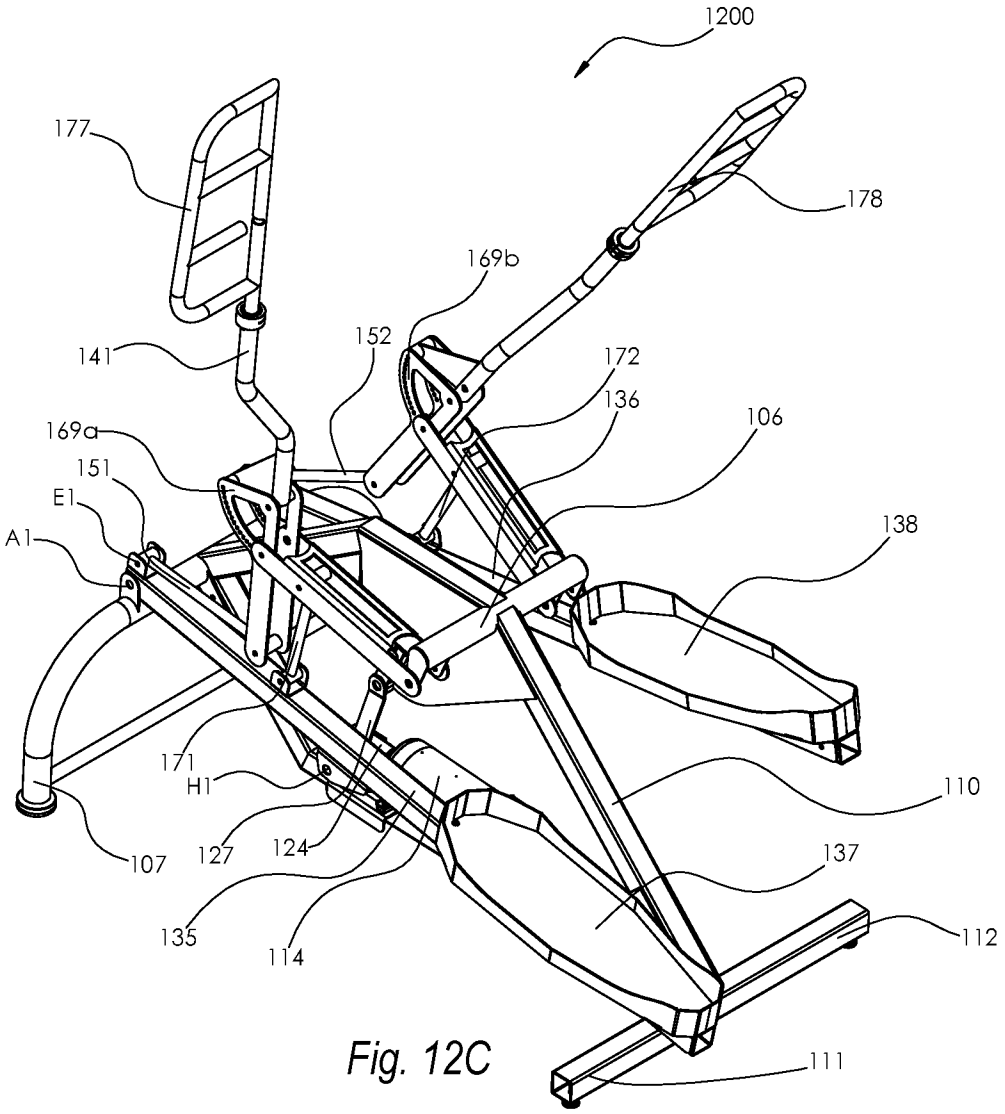

FIGS. 12A, 12B and 12C illustrate an exercise machine 1200 in a front, side, and perspective view, respectively, according to some embodiments. The motion of exercise machine 1200 may in some aspects be similar to the motion illustrated in FIGS. 9A-10F, depending on the location and relative elevation of the features of the exercise machines and resulting angle φ as discussed herein. For example, the motion illustrated in FIGS. 9A-10F can be similar with foot stands 137 extended past or farther than connecting rod joints I1. Structure included from the other figures discussed herein has the same reference numeral for clarity and a description thereof is not repeated. Compared to exercise machine 101, crank joints H1, H2 are located closer to platform arms 135, 136, and electric motor 114, sprocket crank 122, and crank rods 126, 127 are located substantially underneath platform arms 135, 136. For example, crank joints H1, H2 may be located substantially at the center of platform arms 135, 136, within ½ of an inch from the center of platform arms 135, 136, within 1 inch from the center of platform arms 135, 136, within 2 inches from the center of platform arms 135, 136, within 10% of the length of the platform arms 135, 136, within 3 inches from the center of platform arms 135, 136, within 5 inches from the center of platform arms 135, 136, within 8 inches from the center of platform arms 135, 136, within 24 inches from the center of platform arms 135, 136, within 3 inches from the center of platform arms 135, 136, within 10% of the length of the platform arms, within 4 inches from the center of platform arms 135, 136, within 10% of the length of the platform arms, within 20% of the length of platform arms 135, 136 from the center of platform arms 135, 136, within 30% of the length of platform arms 135, 136, within 40% of the length of the platform arms from the center of platform arms 135, 136, including the foregoing values and ranges bordering therein.

Advantageously, an idler gear 123 can be included between electric motor 114 and the drive to chain 120, providing for both additional mechanical reduction and a change in the rotation axis of electric motor 114 compared to sprocket crank 122. While in some embodiments, mechanical reduction is provided by the different size (e.g. different number of teeth) on the sprockets connected through chain 120, the use of idler gear 123 may reduce the amount of mechanical reduction that needs to be provided through chain 120. Advantageously, this may reduce the rotational speed, size and thickness of the sprockets driving chain 120, thus reducing area of friction between chain 120 and the associated sprockets. This may in turn reduce mechanical wear and erosion of chain 120 and the associated sprockets, losses of energy due to friction, operational noise of the mechanism and consumption of lubricants.

It will be appreciated that the relative placement of crank rods 126, 127 relative to the platform arms 135, 136 may be chosen to optimize various design parameters of the machine. For example, particularly with a heavy user, the force of the user exercising on platform arms 135, 136 may create undesired torque (e.g. longitudinal or lateral torque) on the frame. Such torque may be amplified by harmonic vibration (e.g. resonance) of the frame 104, and may cause vibrations, tilting or sliding of the machine during exercise. By moving crank joints H1, H2 closer to the foot stands 137, 138 on the platform arms 135, 136, the effect of such torque may be reduced, for example by moving the center of force closer to the center of gravity of the machine. Additionally, crank rods 126, 127 may be shorter and thus may be characterized by increased stiffness, thus reducing harmonic vibrations. Additionally, the space requirement of the machine (e.g. swept volume during exercise, or stationary volume) may be reduced if crank rods 126, 127, and platform arms 135, 136 may be shortened. The weight distribution of the machine when stationary may be centralized by locating the more massive or heavier components, e.g. electric motor 114 and crank rods 126, 127, closer to the center of the machine.

Exercise machine 1200 may further include a gear housing 124 surrounding sprocket crank 122, idler gear 123, chain 120 and electric motor 114 as discussed herein. This may protect the user from getting caught (e.g. with clothes or extremities) in sprocket crank 122.

Figure 12D:
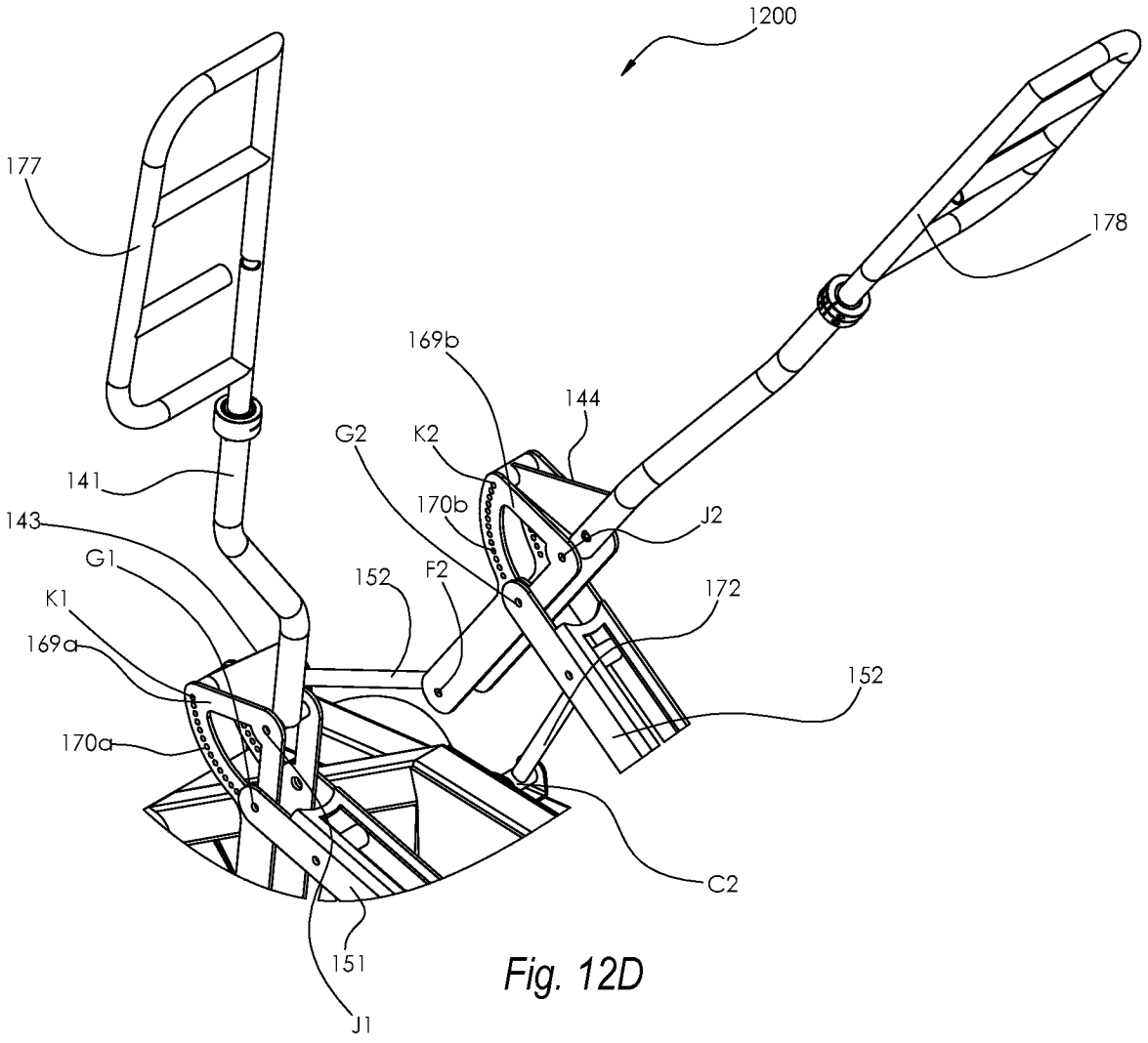
FIG. 12D illustrates a detail view of linkages of an exercise machine according to some embodiments.

With reference to FIG. 12D, a detail view of the linkage mechanism of exercise machine 1200 is illustrated. It will be appreciated that compare to exercise machine 100, brackets 155, 156, lower link brackets 167*b*, 168*b*, and/or upper link brackets, 167*a*, 168*a* may be combined in an angular bracket 169*a*, 169*b*. Angular brackets 169*a*, 169*b* may be attached to handle arms 141, 142 via first handle arm connections J1, J2 and second handle arm connections K1, K2. Advantageously, angular brackets 169*a*, 169*b* may comprise a slot, ridge or arrangement of openings (e.g. openings 170*a*, 170*b*) in which the angular bracket 169*a*, 169*b* can be fastened (e.g. with screws, nuts and shims or bearings) to upper control arms 145, 146, thus providing a continuous or incremented adjustment via a selection of a position in the slot, ridge or arrangement of openings, such as one opening of openings 170*a*, 170*b* for the position of second handle arm connections K1, K2 as discussed herein. This may allow for adjustment of the relative position of handle arms 141, 142 relative to angular brackets 169*a*, 169*b* by loosening (e.g. by removing pins or bolt securing) second handle arm connections K1, K2), adjusting (e.g. pivoting handle arms 141, 142 around first handle arm connections J1, J2) and re-securing second handle arm connections K1, K2.

The mechanical connection between handle arms 141, 142 and second handle arm connections K1, K2 may be provided by a handle arm cantilever 143, 144. The handle arm cantilevers 143, 144 may be attached (e.g. bolted) to handle arms 141, 142; advantageously, handle arm cantilever 143, 144 may be attached to handle arms 141, 142 at a point that is higher than or offset from second handle arm connections K1, K2 to reduce the stress (e.g. compressive and/or tensile stress during different parts of the cycle of motion of exercise machine 1200) exerted on, and thus improve the stability of, handle arm cantilevers 143, 144. A second mechanical connection between handle arms 141, 142 and angular brackets 169*a*, 169*b* may be provided via first handle arm connections J1, J2.

Advantageously, the use of both first handle arm connections J1, J2 and second handle arm connections K1, K2 offset from each other allows the use of rotational joints for one or more of second handle arm connections K1, K2 and first handle arm connections J1, J2 while still preventing rotation of handle arms 141, 142 relative to angular brackets 169*a*, 169*b*. The adjustability of at least the second handle arm connections K1, K2 may allow for fine-grained adjustment of the lever mechanism moving handle arms 141, 142 and thus the range of motion of handle arms 141, 142 as discussed herein. For example, to facilitate a more upright posture of the user, one of openings 170*a*, 170*b* may be chosen for second handle arm connections K1, K2 so as to position handle arms 141, 142 more upright; conversely, where a lower posture is desired, another one of openings 170*a*, 170*b* may be chosen so as to position handle arms 141, 142 more inclined.

Figure 13A:
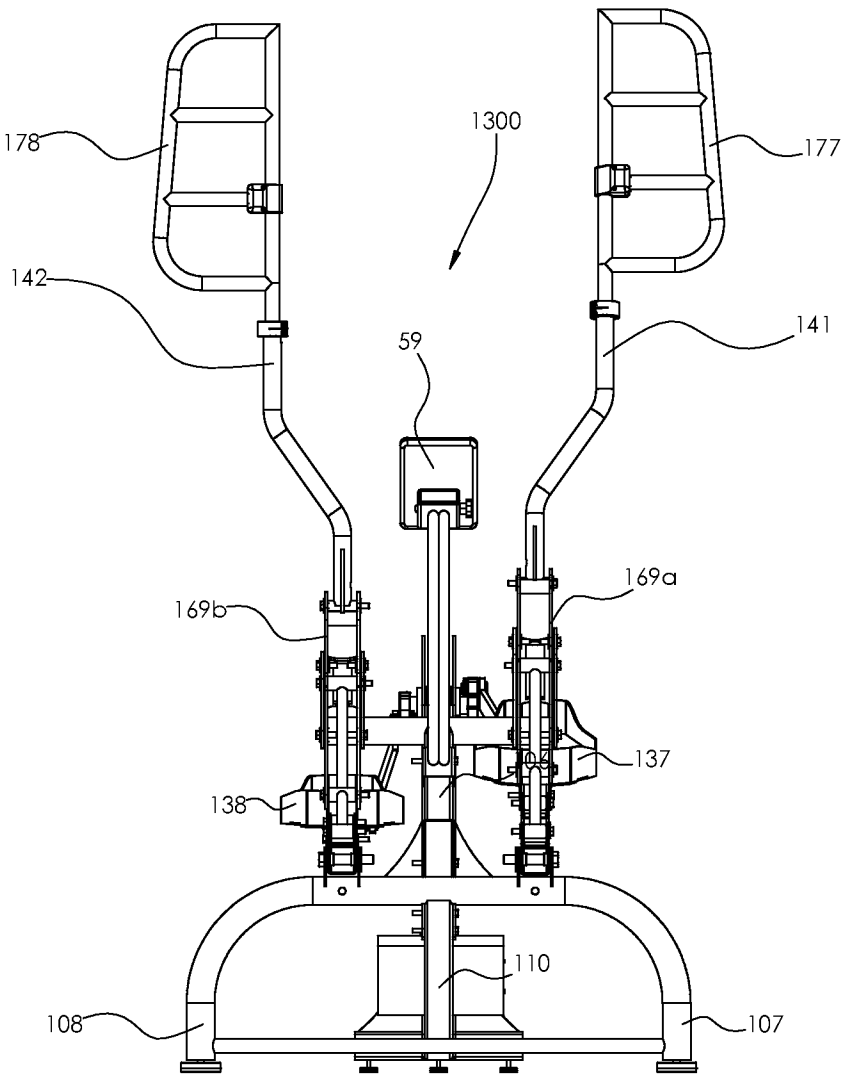
FIGS. 13A, 13B and 13C illustrate a front, side and perspective view, respectively, of an exercise machine according to some embodiments.
Figure 13B:
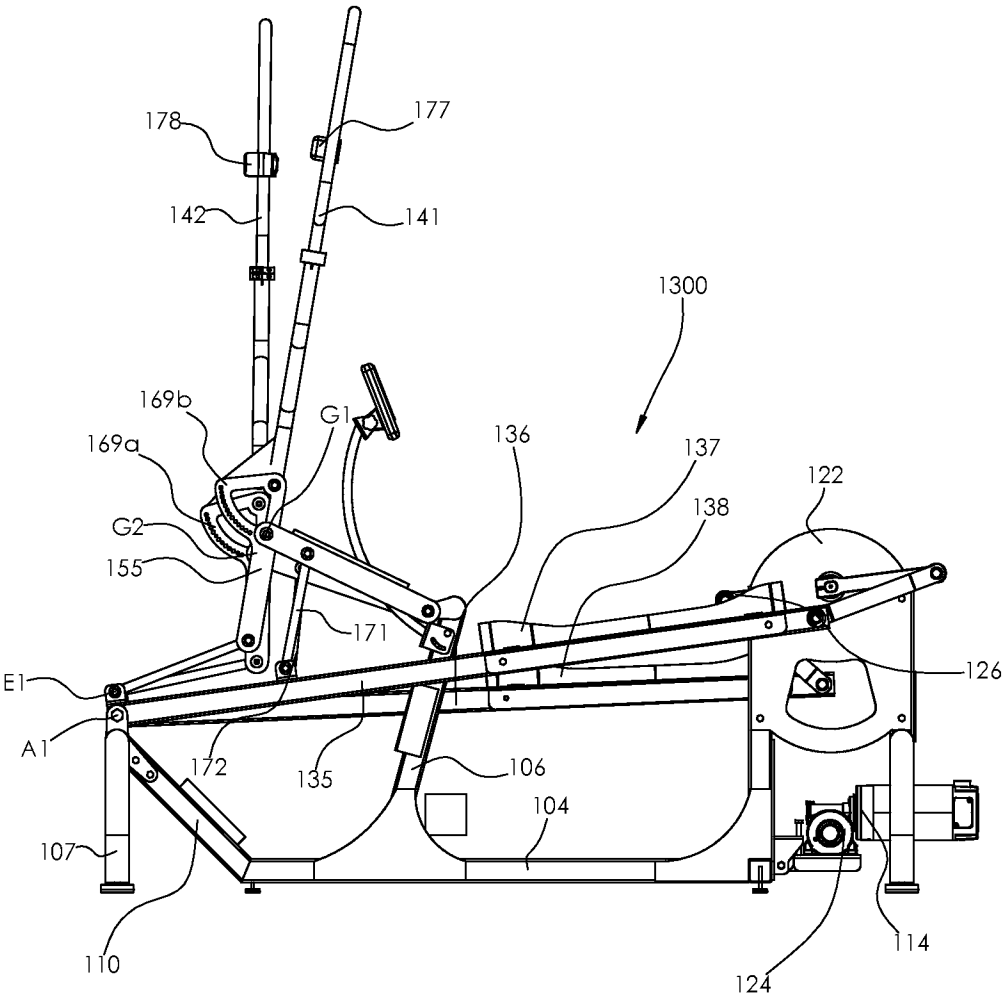
Figure 13C:
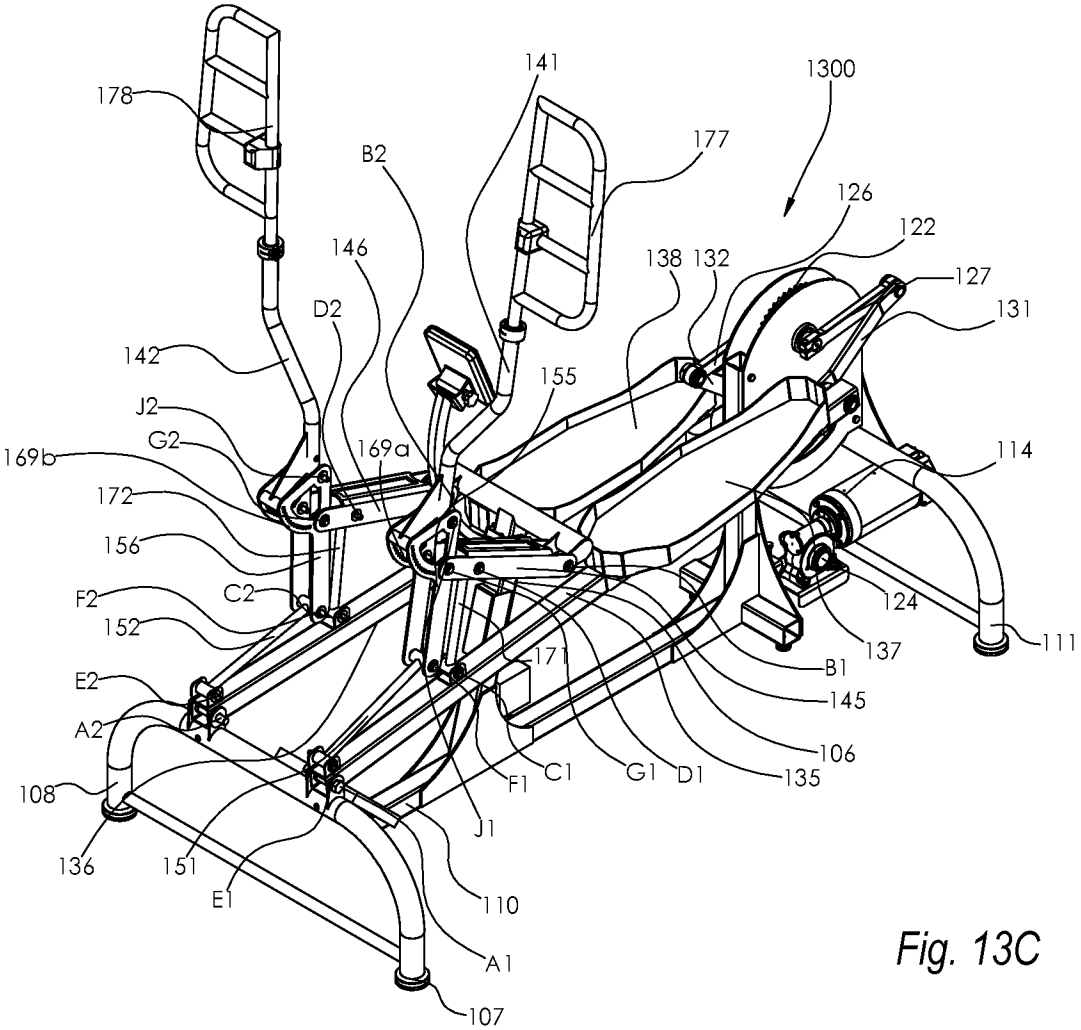

FIGS. 13A, 13B and 13C illustrate an exercise machine 1300 in a front, side and perspective view, respectively, according to some embodiments. The motion of exercise machine 1300 may in some aspects be similar to the motion illustrated in FIGS. 9A-9F. Structure included from the other figures discussed herein has the same reference numeral for clarity and a description thereof is not repeated. Electric motor 114 may be mounted substantially below sprocket crank 122, thus reducing the length of the overall machine. Advantageously, because electric motor 114 is located close to the bottom of machine 1300 and substantially below crank joints H1, H2, it may act to lower the center of gravity and reduce any movement or vibrations transmitted to the frame 104 when the mechanism is in operation.

Figure 14A:
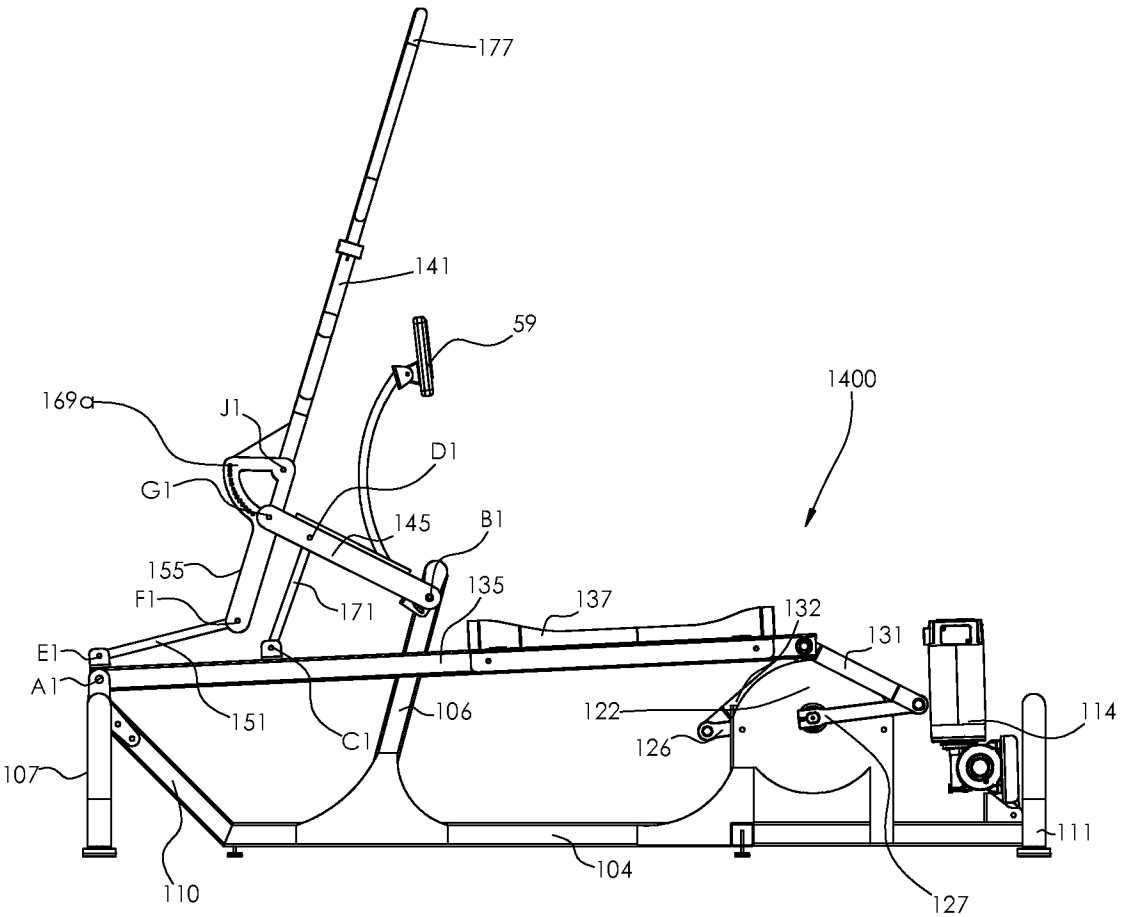
FIGS. 14A, 14B and 14C illustrate a front, side and perspective view, respectively, of an exercise machine according to some embodiments.
Figure 14B:
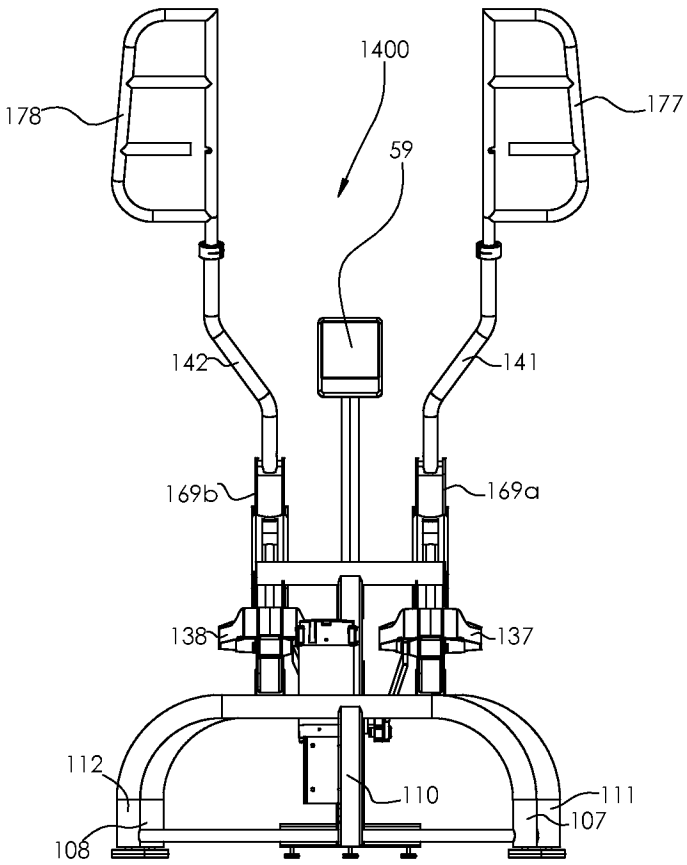
Figure 14C:
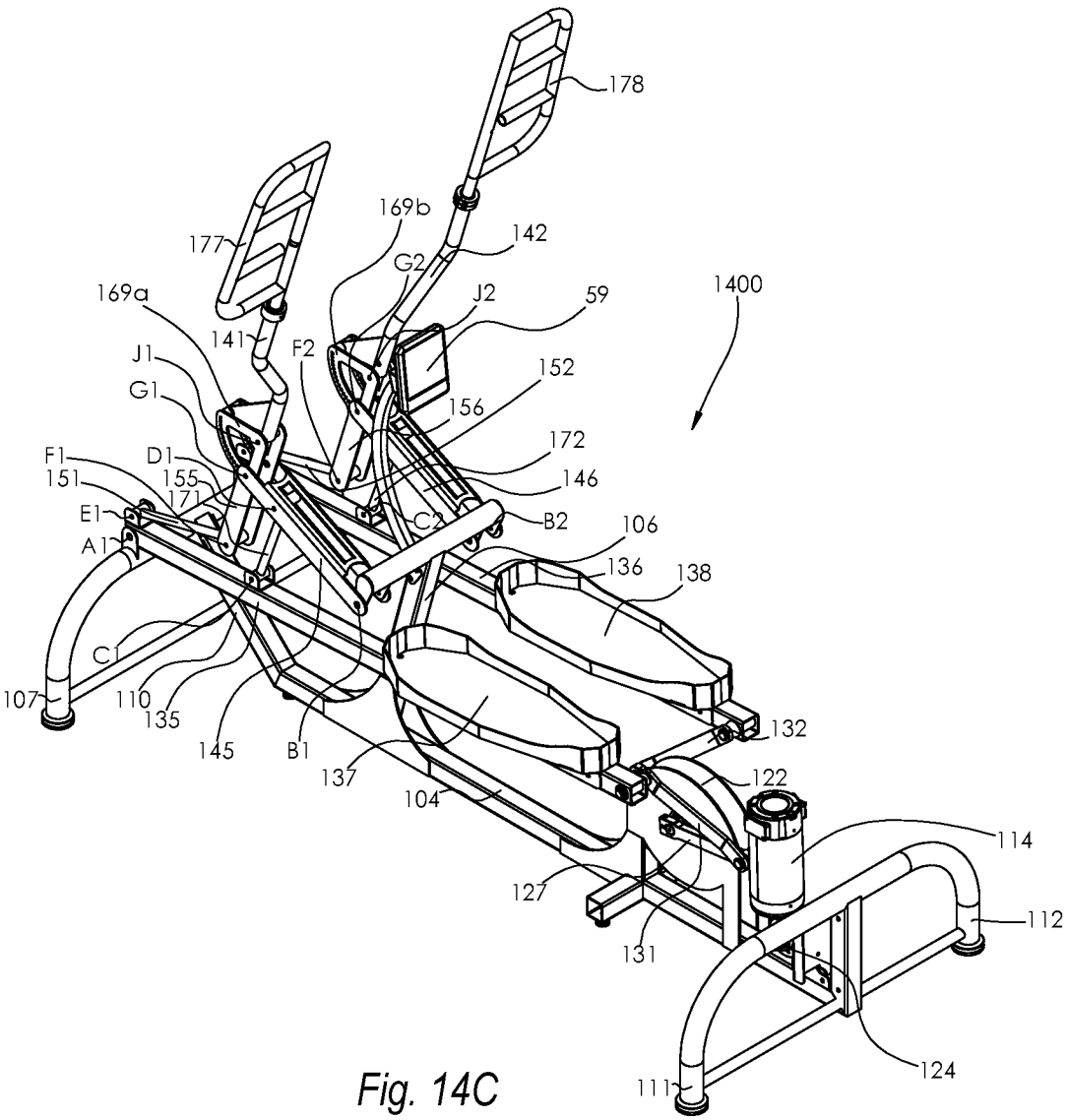

FIGS. 14A, 14B and 14C illustrate an exercise machine 1300 according to some embodiments. The motion of exercise machine 1400 may in some aspects be similar to the motion illustrated in FIGS. 10A-10F. Structure included from the other figures discussed herein has the same reference numeral for clarity and a description thereof is not repeated. Interface 55 (see FIG. 5) may be implemented via a touch-sensitive display 59. Touch-sensitive display 59 may be, for example, a liquid-crystal display (LCD) with a resistive or capacitive touch panel attached to it. Advantageously, a capacitive touch panel may be used to prevent resistance to false readings from exposure of touch-sensitive display 59 to sweat or moisture during the exercise. Touch-sensitive display 59 may be connected to control unit 118, e.g. for receiving graphical display output and reporting touch events. Touch-sensitive display 59 may be mounted as protruding from support tower 106; this may allow the user to read off and interact with touch-sensitive display 59 during exercise. Additionally, touch-sensitive display 59 may advantageously comprise various other structural features, including a backlight (e.g. an LED backlight), one or more rotational hinges imparting one or more degrees of freedom (e.g. to accommodate users of different sizes), and/or one or more translational hinges imparting one or more degrees of translational freedom (e.g. to accommodate users of different sizes or arm lengths. Advantageously, the connection between control unit 118 and touch-sensitive display 59 may be made inside support tower 106, so as to remove any wiring from the reach and sight of the user. Alternatively, control unit 118 and touch-sensitive display 59 may be connected wirelessly (e.g. via Bluetooth, Wi-Fi, or a similar packet radio standard).

Figure 15:
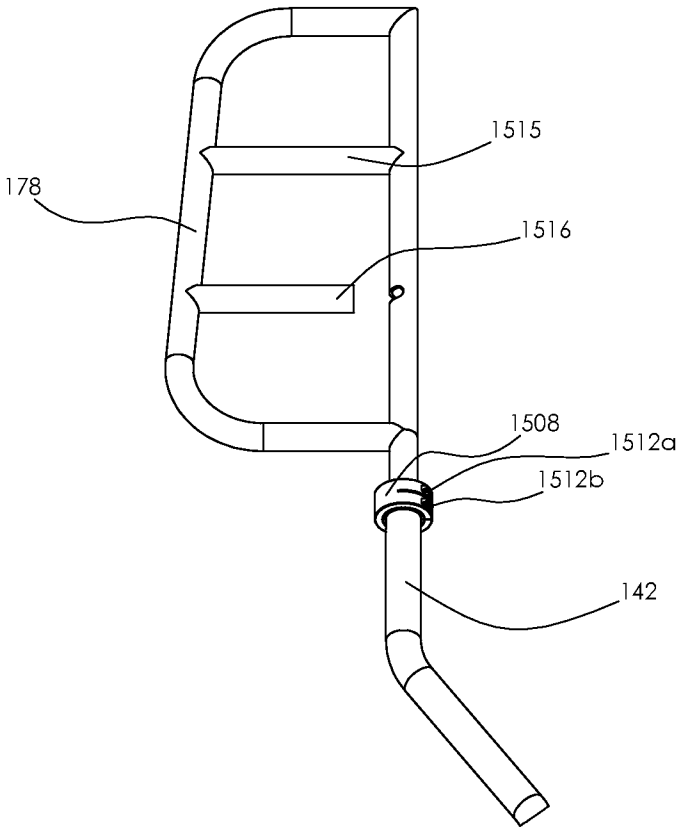
FIG. 15 illustrates a close-up view of a handle arm with an attached hand grip according to some embodiments.

FIG. 15 illustrates a close-up view of a handle arm, such as handle arm 142, with an attached hand grip, such as hand grip 178. Handle arm 142 may be attached to its hand grip 178 via a fitting, such as compressive fitting 1508. Compressive fitting 1508 may comprise a segmented ring or shell, the ends of which can be fastened or compressed via screws or bolts, such as bolts 1512*a*, 1512*b*. Advantageously, this allows compressive fitting 1508 to be fastened and released with basic tools, and thus facilitates the exchange of hand grips attached to handle arm 142. Hand grip 178 may comprise a straight crossbar 1515 and a segmented crossbar 1516. This may allow the user to use different grips (e.g. supinated grip, neutral grip, pronated grip) on the hand grip 178. Advantageously, a user desiring to use a pronated grip (e.g. palms facing away from the user), the use of segmented crossbar 1516 may allow the user's thumbs to rest in a more relaxed position next to the hand. A user desiring to use a supinated grip may desire to use straight crossbar 1515 to provide for an increased surface area for the grip.

Various modifications to the designs are contemplated. For example, as illustrated, the sprocket crank 122 may be moved upwards relative to platform hinges A1, A2 to create a negative incline, or may be moved downwards relative to platform hinges A1, A2 to create a positive incline. Such relative placement of the sprocket crank 122 relative to the platform hinges A1, A2 may be based on the frame 104 and other component arrangement as illustrated, for example, in FIG. 1A relative to FIG. 1B. In some embodiments, relative placement of the sprocket crank 122 relative to the platform hinges A1, A2 may be achieved via hydraulic systems that move the sprocket crank 122 and/or platform hinges A1, A2.

Angle φ may take any value. For example, angle φ may be equal to 0 degrees (machine is relatively level). In various embodiments, this may correspond to the sprocket crank 122 being at a substantially same vertical level as the platform hinges A1, A2. Angle φ may be negative, giving a negative incline as illustrated in FIGS. 9A-9F; for example, angle φ may be about 5 degrees negative, about 10 degrees negative, about 15 degrees negative, about 20 degrees negative, or more negative, including the foregoing values and the ranges bordering therein. Angle φ may be positive, as illustrated in FIGS. 10A-10F giving a positive incline; for example, φ may be about 5 degrees positive, about 10 degrees positive, about 15 degrees positive, about 20 degrees positive, or more positive, including the foregoing values and the ranges bordering therein. In various embodiments, this may correspond to the sprocket crank 122 may be offset from the platform hinges A1, A2 by about 3 inches, about 6 inches, about 12 inches, about 18 inches, about 24 inches, or more than 24 inches vertically in either direction, including the foregoing values and the ranges bordering therein.

It will be appreciated that the bias on the incline of the platform arms 135, 136 may be chosen to be above or greater than a predetermined threshold or value (e.g. by choosing a relatively large positive or negative values for angle φ) that the platform arms 135, 136, during their entire cycle of motion, remain positively inclined, or remain negatively inclined. The bias may also be chosen smaller or less than a predetermined threshold or value (or within a predetermined range), so that during the cycle of motion, the platform arms 135, 136 are negatively inclined during one phase, and are positively inclined during another phase of the cycle of motion. This allows, for example, a cycle of motion with a relatively smaller positive incline during one phase, and a relatively larger positive incline during another phase, or vice versa. For example, angle φ (and other machine parameters) may be appropriately chosen and configured so that, over one cycle of motion, the maximum negative inclination substantially equals the maximum positive inclination, that the maximum negative inclination exceeds the maximum positive inclination by about 20%, by about 40%, by about 60%, by about 80%, by about 100% or by more than 100%, including the foregoing values and ranges bordering therein, or that the maximum positive inclination exceeds the maximum negative inclination by about 20%, by about 40%, by about 60%, by about 80%, by about 100%, or by more than 100%, including the foregoing values and ranges bordering therein. Advantageously, if the machine is configured so that the maximum negative inclination exceeds the maximum positive inclination, increased stretching can be achieved during the platform arms' 135, 136 upwards motion while reducing the risk of knee over flexion or discomfort during the platform arms' 135, 136 downwards motion.

If the machine is configured so that the maximum negative inclination exceeds the maximum positive inclination, it may be advantageous to use a lower R/C, i.e. the ratio of connecting rod 131, 132 length R to crank rod 126, 127 length C. As discussed above with reference to FIG. 8, this may reduce the time each platform arm 135, 136 spends near its most elevated position and correspondingly reduce the time during which the user's knee is in or near its most flexed position, as compared to at or near its most extended position in the motion cycle. Advantageously, this may make the motion be more similar to a natural human walking motion on downwards sloped terrain.

For example, the crank mechanism illustrated in FIG. 1A may have a total travel range of about 18 inches. The crank mechanism of FIG. 1A may provide a lift movement range of the platform arms 135, 136 of about 14 inches. The crank mechanism of FIG. 1A may provide a drop movement range of the platform arms 135, 136 of about 4 inches. Accordingly, the crank mechanism of FIG. 1A provides a guided motion that lifts the lower body of the user for a greater or longer extent or range relative to drop the lower body of the user experiences.

As another example, the crank mechanism illustrated in FIG. 1C may also have a total travel range of about 18 inches. The crank mechanism of FIG. 1C may provide a lift movement range of the platform arms 135, 136 of about 4 inches. The crank mechanism of FIG. 1C may provide a drop movement range of the platform arms 135, 136 of about 14 inches. Accordingly, the crank mechanism of FIG. 1C provides a guided motion that lifts the lower body of the user for a smaller or shorter extent or range relative to drop the lower body of the user experiences.

List of Example Numbered Embodiments

The following is a list of example numbered embodiments. The features recited in the below list of example embodiments can be combined with additional features disclosed herein. Furthermore, additional inventive combinations of features are disclosed herein, which are not specifically recited in the below list of example embodiments and which do not include the same features as the specific embodiments listed below. For sake of brevity, the below list of example embodiments does not identify every inventive aspect of this disclosure. The below list of example embodiments are not intended to identify key features or essential features of any subject matter described herein.

1. An exercise machine for flexing and extending a body of a person while exercising, the exercise machine comprising:

a frame configured to rest against a support surface, the frame comprising a front end and a back end;

a first platform arm pivotally connected to the frame about a first pivot joint proximate to the front end of the frame to flex and extend at least a portion of the lower body of the body of the person when the person is using the exercise machine;

a second platform arm pivotally connected to the frame about a second pivot joint proximate to the front end of the frame to flex and extend the at least a portion of the lower body of the body of the person when the person is using the exercise machine;

a first handle arm connected to the first platform arm, the first handle arm configured to move back and forth between the front end and the back end of the frame when the first platform arm pivots about the first pivot joint to flex and extend at least a portion of the upper body of the body of the person when the person is using the exercise machine; and a second handle arm connected to the second platform arm, the second handle arm configured to move back and forth between the front end and the back end of the frame when the second platform arm pivots about the second pivot joint to flex and extend the at least a portion of the upper body of the body of person when the person is using the exercise machine.

2. The exercise machine of embodiment 1, further comprising a motor connected to the frame and the first and second platform arms, wherein when the motor is in operation, the first and second platform arms are driven to pivot about the first and second pivot joints, respectively.

3. The exercise machine of embodiment 1, further comprising a crank linkage mechanism connecting the motor to the first and second platform arms, wherein the crank linkage mechanism is configured to transfer a rotating movement of the motor into pivoting movement of the first and second platform arms.

4. The exercise machine of embodiment 3, wherein the crank linkage mechanism comprises:

a drive wheel connected to the motor, wherein the drive wheel rotates as the motor rotates;

a first crank rod and a second crank rod connected to the drive wheel, wherein the first and second crank rods are fixed to the drive wheel to rotate with the drive wheel; and a first connecting rod and a second connecting rod hingedly connected to the first and second crank rod, respectively, and hingedly connected to the first and second platform arms, respectively, wherein the first and second connecting rods are configured to rotate relative to the first and second crank rods and configured to rotate relative to first and second platform arms, wherein the first and second platform arms pivot about the first and second pivot joints, respectively, when the first and second connecting rods are moved up and down via rotation of the drive wheel by the motor and the first and second connecting rods rotate relative to both the first and second connecting rods and the first and second platform arms.

5. The exercise machine of any one of embodiments 1 to 4, further comprising an arm linkage mechanism connecting the first and second platform arms with the first and second handle arms, respectively, wherein the arm linkage mechanism is configured to transfer pivoting movement of the first and second platform arms into back and forth movement of the first and second hand arms, respectively.

6. The exercise machine of embodiment 5, wherein the arm linkage mechanism comprises:

a support tower connected to the frame, the support tower extending substantially upwards from frame relative to the support surface;

a first upper control arm pivotally connected to the support tower and pivotally connected to the first handle arm;

a second upper control arm pivotally connected to the support tower and pivotally connected to the second handle arm;

a first platform bracket pivotally connected to the first upper control arm and pivotally connected to the first platform arm; and a second platform bracket pivotally connected to the second upper control arm and pivotally connected to the second platform arm, wherein the first and second handle arms are moved back and forth by the first and second platform brackets when the first and second platform brackets are moved by the first and second platform arms pivoting about the first and second pivot joints, respectively, while the first and second hand arms pivot about the support tower.

7. The exercise machine of embodiment 6, wherein the arm linkage mechanism further comprises:

a first lower control arm pivotally connected to the frame and pivotally connected to the first handle arm; and a second lower control arm pivotally connected to the frame and pivotally connected to the second handle arm, wherein the first and second lower control arms pivot about both the frame and the first and second handle arms, respectively, when the first and second handle arms are moved back and forth.

8. The exercise machine of any one of embodiments 1 to 7, wherein the first and second platform arms pivot in opposition 180 degrees out of phase with each other about the first and second pivot joints, respectively.

9. The exercise machine of any one of embodiments 1 to 8, wherein the first and second handle arms move back and forth in opposition 180 degrees out of phase with each other.

10. The exercise machine of any one of embodiments 1 to 7, wherein the first and second platform arms pivot together in phase with each other about the first and second pivot joints, respectively.

11. The exercise machine of any one of embodiments 1 to 7 or 10, wherein the first and second handle arms move back and forth together in phase with each other.

12. The exercise machine of any one of embodiments 1 to 11, wherein while the first platform arm moves upwards relative to the ground surface, the first handle arm moves toward the back end of the frame.

13. The exercise machine of any one of embodiments 1 to 12, wherein while the second platform arm moves upwards relative to the ground surface, the second handle arm moves toward the back end of the frame.

14. The exercise machine of any one of embodiments 1 to 13, wherein while the first platform arm moves downwards relative to the ground surface, the first handle arm moves toward the front end of the frame.

15. The exercise machine of any one of embodiments 1 to 14, wherein while the second platform arm moves downwards relative to the ground surface, the second handle arm moves toward the front end of the frame.

16. The exercise machine of any one of embodiments 1 to 15, wherein the first and second platform arms move in a substantially vertical direction relative to the support surface from the perspective of the user.

17. The exercise machine of any one of embodiments 1 to 16, wherein the first and second handle arms move in a substantially horizontal direction relative to the support surface from the perspective of the user.

18. The exercise machine of any one of embodiments 1 to 17, further comprising one or more dampeners between the frame and the first and second platform arms, the one or more dampeners configured to resist movement of the first and second platform arms depending on the position of the first and second platform arms about the first and second pivot joints, respectively.

19. The exercise machine of embodiment 18, wherein the one or more dampeners are configured to provide a resistive force against movement of the first and second platform arms to facilitate the person manually exercising on the exercise machine without the first and second platform arms being moved by the exercise machine.

20. The exercise machine of any of embodiments 1 to 19, further comprising a hydraulic system configured to move the first and second platform arms.

21. The exercise machine of embodiment 20, wherein the hydraulic system is configured to reciprocate the first and second platform arms as the platforms move about the first and second pivot joints.

22. The exercise machine of any of embodiments 1 to 21, further comprising a stepper motor configured to move the first and second platform arms.

23. The exercise machine of embodiment 22, wherein the stepper motor is configured to reciprocate the first and second platform arms as the platforms move about the first and second pivot joints.

24. An exercise machine comprising:

a frame:

a motor attached to the frame, the motor driving a shaft in a plane of rotation;

one or more cranks connected to the shaft and rotatable in the plane of rotation with respect to the shaft;

one or more connecting rods connected to the one or more cranks so as to be rotatable in the plane of rotation with respect to the one or more cranks, wherein a length of the connecting rods is at least as great as a length of the cranks;

one or more platform arms connected to the one or more connecting rods and configured to move in a first periodic trajectory, wherein the one or more platform arms comprise foot stands; and one or more handle arms configured to be grasped by hands of the user and configured to be driven by the motor so as to move in a second periodic trajectory.

25. The exercise machine of embodiment 24, wherein the length of the connecting rods exceeds the length of the cranks by at least 10%.

26. The exercise machine of embodiment 24, wherein the length of the connecting rods exceeds the length of the cranks by at least 20%.

27. The exercise machine of any one of embodiments 24 to 26, wherein the one or more handle arms comprise a handle structure, the handle structure comprises a grid extending in at least two dimensions.

28. The exercise machine of any one of embodiments 24 to 27, wherein the foot stands are not rotatable with respect to the one or more platform arms.

29. An exercise machine comprising:

a frame;

a motor attached to the frame;

one or more platform arms, configured to support feet of a user and configured to be driven by the motor so as to periodically move along a sagittal plane; and one or more handle arms, configured to be grasped by hands of the user and configured to be driven by the motor so as to periodically move along the sagittal plane, wherein the platform arms are configured so as not to allow for rotation between the feet of the user and the platform arms.

30. The exercise machine of embodiment 29, wherein the movement of the platform arms is substantially constrained to one coronal plane.

31. The exercise machine of embodiment 30, wherein the movement of the platform arms is configured to induce partial lifting of the user's heels from the platform arms.

32. The exercise machine of any one of embodiments 29 to 31, wherein the movement of the handle arms is substantially constrained to one axial plane.

33. The exercise machine of any one of embodiments 29 to 32, wherein the movement of the platform arms is substantially constrained to one coronal plane and the movement of the handle arms is substantially constrained to one axial plane.

34. The exercise machine of any one of embodiments 29 to 33, wherein the machine further comprises one or more shock absorbers connected to the one or more platform arms.

35. The exercise machine of embodiment 34, wherein the shock absorber is configured so as to provide a resistance when the machine is set in period motion by the user without the motor being engaged, so as to permit exercising without an external source of power.

36. The exercise machine of any one of embodiments 29 to 35, wherein the motor drives the platform arms via a reduction gear.

37. The exercise machine of any one of embodiments 29 to 36, wherein the one or more handle arms comprise a handle structure, the handle structure configured to permit the user to grasp the handle structure using a plurality of gripping techniques.

38. An exercise machine for flexing and extending a body of a person while exercising, the exercise machine comprising:

a frame configured to rest against a support surface, the frame comprising a front end and a back end;

a first platform arm pivotally connected to the frame about a first pivot joint proximate to the front end of the frame configured to flex and extend at least a portion of the lower body of the body of the person;

a second platform arm pivotally connected to the frame about a second pivot joint proximate to the front end of the frame configured to flex and extend the at least a portion of the lower body of the body of the person;

a first handle arm connected to the first platform arm, the first handle arm configured to move back and forth between the front end and the back end of the frame, wherein the first handle is configured to be moved back and forth by the first platform arm pivoting about the first pivot joint, the first handle arm configured to flex and extend at least a portion of the upper body of the body of the person; and a second handle arm connected to the second platform arm, the second handle arm configured to move back and forth between the front end and the back end of the frame, wherein the second handle is configured to be moved back and forth by the second platform arm pivoting about the second pivot joint, the second handle arm configured to flex and extend the at least a portion of the upper body of the body of person.

39. The exercise machine of embodiment 38, further comprising a motor connected to the frame and the first and second platform arms, wherein the motor is configured to drive the first and second platform arms to pivot about the first and second pivot joints, respectively.

40. The exercise machine of embodiment 39, further comprising a crank linkage mechanism connecting the motor to the first and second platform arms, wherein the crank linkage mechanism is configured to transfer a rotating movement of the motor into pivoting movement of the first and second platform arms.

41. The exercise machine of embodiment 40, wherein the crank linkage mechanism comprises:

a drive wheel connected to the motor, wherein the motor is configured to rotate the drive wheel;

a first crank rod and a second crank rod connected to the drive wheel, wherein the first and second crank rods are fixed to the drive wheel to rotate with the drive wheel; and a first connecting rod and a second connecting rod hingedly connected to the first and second crank rod, respectively, and hingedly connected to the first and second platform arms, respectively, wherein the first and second connecting rods are configured to rotate relative to the first and second crank rods and configured to rotate relative to first and second platform arms, wherein the motor is configured to rotate the first and second crank rods relative to both the first and second connecting rods and the first and second platform, wherein first and second crank rods are configured to move the connecting rods up and down, and wherein the connecting rods are configured to pivot the first and second platform arms about the first and second pivot joints.

42. The exercise machine of any one of embodiments 38 to 41, further comprising an arm linkage mechanism connecting the first and second platform arms with the first and second handle arms, respectively, wherein the arm linkage mechanism is configured to transfer pivoting movement of the first and second platform arms into back and forth movement of the first and second hand arms, respectively.

43. The exercise machine of embodiment 42, wherein the arm linkage mechanism comprises:

a support connected to the frame;

a first upper control arm pivotally connected to the support and pivotally connected to the first handle arm, the first upper control arm extending between the support and the first handle arm;

a second upper control arm pivotally connected to the support tower and pivotally connected to the second handle arm, the second upper control arm extending between the support and the second handle arm;

a first platform bracket pivotally connected to the first upper control arm and pivotally connected to the first platform arm, the first platform bracket extending between the first upper control and the first platform arm; and a second platform bracket pivotally connected to the second upper control arm and pivotally connected to the second platform arm, the second platform bracket extending between the second upper control and the second platform arm, wherein the first and second handle arms are configured to be moved back and forth by the first and second platform brackets via the first and second platform brackets being moved by the first and second platform arms pivoting about the first and second pivot joints, respectively, with the first and second upper control arms pivoting about the support.

44. The exercise machine of embodiment 43, wherein the arm linkage mechanism further comprises:

a first lower control arm pivotally connected to the frame proximate to the front end and pivotally connected to the first handle arm; and a second lower control arm pivotally connected to the frame proximate to the front end and pivotally connected to the second handle arm, wherein the first and second lower control arms are configured to pivot about both the frame and the first and second handle arms, respectively, to guide the first and second handle arms back and forth.

45. The exercise machine of any one of embodiments 38 to 44, wherein the first and second platform arms are configured to pivot in opposition 180 degrees out of phase with each other about the first and second pivot joints, respectively.

46. The exercise machine of any one of embodiments 38 to 45, wherein the first and second handle arms are configured to move back and forth in opposition 180 degrees out of phase with each other.

47. The exercise machine of any one of embodiments 38 to 44, wherein the first and second platform arms are configured to pivot together in phase with each other about the first and second pivot joints, respectively.

48. The exercise machine of any one of embodiments 38 to 44 or 47, wherein the first and second handle arms are configured to move back and forth together in phase with each other.

49. The exercise machine of any one of embodiments 38 to 48, wherein upward movement of the first platform arm relative to the ground surface causes the first handle arm to move toward the back end of the frame.

50. The exercise machine of any one of embodiments 38 to 49, wherein upward movement of the second platform arm relative to the ground surface causes the second handle arm to move toward the back end of the frame.

51. The exercise machine of any one of embodiments 38 to 50, wherein downward movement of the first platform arm relative to the ground surface causes the first handle arm to move toward the front end of the frame.

52. The exercise machine of any one of embodiments 38 to 51, wherein downward movement of the second platform arm relative to the ground surface causes the second handle arm to move toward the front end of the frame.

53. The exercise machine of any one of embodiments 38 to 52, wherein the first and second platform arms are configured to move in a substantially vertical direction relative to the support surface from the perspective of the user.

54. The exercise machine of any one of embodiments 38 to 53, wherein the first and second handle arms are configured to move in a substantially horizontal direction relative to the support surface from the perspective of the user.

55. The exercise machine of any one of embodiments 38 to 54, further comprising one or more dampeners between the frame and the first and second platform arms, the one or more dampeners configured to resist movement of the first and second platform arms depending on the position of the first and second platform arms about the first and second pivot joints, respectively.

56. The exercise machine of embodiment 55, wherein the one or more dampeners are configured to provide a resistive force against movement of the first and second platform arms to facilitate the person manually exercising on the exercise machine without the first and second platform arms being moved by the exercise machine.

57. The exercise machine of any of embodiments 38 to 56, further comprising a hydraulic system configured to move the first and second platform arms.

58. The exercise machine of embodiment 57, wherein the hydraulic system is configured to reciprocate the first and second platform arms and pivot the first and second platform arms about the first and second pivot joints.

59. The exercise machine of any of embodiments 38 to 58, further comprising a stepper motor configured to move the first and second platform arms.

60. The exercise machine of embodiment 59, wherein the stepper motor is configured to reciprocate the first and second platform arms and pivot the first and second platform arms about the first and second pivot joints.

61. An exercise machine comprising:

a frame:

a motor attached to the frame, the motor driving a shaft in a plane of rotation;

one or more cranks connected to the shaft and rotatable in the plane of rotation with respect to the shaft;

one or more connecting rods connected to the one or more cranks so as to be rotatable in the plane of rotation with respect to the one or more cranks, wherein a length of the connecting rods is greater than or equal to a length of the cranks;

one or more platform arms connected to the one or more connecting rods and configured to move in a first periodic trajectory, wherein the one or more platform arms comprise foot stands; and one or more handle arms configured to be grasped by hands of the user and configured to be driven by the motor so as to move in a second periodic trajectory.

62. The exercise machine of embodiment 61, wherein the length of the connecting rods exceeds the length of the cranks by at least 10%.

63. The exercise machine of embodiment 61, wherein the length of the connecting rods exceeds the length of the cranks by at least 20%.

64. The exercise machine of any one of embodiments 61 to 63, wherein the one or more handle arms comprise a handle structure, the handle structure comprises a grid extending in at least two dimensions.

65. The exercise machine of any one of embodiments 61 to 64, wherein the foot stands are not rotatable with respect to the one or more platform arms.

66. An exercise machine comprising:

a frame;

a motor attached to the frame;

one or more platform arms, configured to support feet of a user and configured to be driven by the motor so as to periodically move along a sagittal plane; and one or more handle arms, configured to be grasped by hands of the user and configured to be driven by the motor so as to periodically move along the sagittal plane, wherein the platform arms are configured so as not to allow for rotation between the feet of the user and the platform arms.

67. The exercise machine of embodiment 66, wherein the movement of the platform arms is substantially constrained to one coronal plane.

68. The exercise machine of embodiment 67, wherein the movement of the platform arms is configured to induce partial lifting of the user's heels from the platform arms.

69. The exercise machine of any one of embodiments 66 to 68, wherein the movement of the handle arms is substantially constrained to one axial plane.

70. The exercise machine of any one of embodiments 66 to 69, wherein the movement of the platform arms is substantially constrained to one coronal plane and the movement of the handle arms is substantially constrained to one axial plane.

71. The exercise machine of any one of embodiments 66 to 70, wherein the machine further comprises one or more shock absorbers connected to the one or more platform arms.

72. The exercise machine of embodiment 71, wherein the shock absorber is configured so as to provide a resistance when the machine is set in period motion by the user without the motor being engaged, so as to permit exercising without an external source of power.

73. The exercise machine of any one of embodiments 66 to 72, wherein the motor drives the platform arms via a reduction gear.

74. The exercise machine of any one of embodiments 66 to 36, wherein the one or more handle arms comprise a handle structure, the handle structure configured to permit the user to grasp the handle structure using a plurality of gripping techniques.

75. The exercise machine of any one of embodiments 66 to 74, further comprising a control unit configured to control the motor.

76. The exercise machine of embodiment 75, further comprising a user presence sensor configured to detect the presence of a user on the exercise machine, wherein the control unit is configured to reduce or inhibit motion of the motor upon the presence of the user not being detected.

77. The exercise machine of embodiment 66 or 76, wherein the motor control unit is further configured to position the motor in a predetermined position upon the presence of the user not being detected.

78. The exercise machine of embodiment 77, wherein the predetermined position is substantially symmetric with respect to a horizontal plane.

79. The exercise machine of any of embodiments 66 to 78, further comprising an emergency switch configured to interrupt an electrical connection to the motor.

80. The exercise machine of any of embodiments 66 to 79, wherein the control unit is further configured to control the motor to operate on a predetermined torque or power curve.

81. The exercise machine of embodiment 80, wherein the torque or power curve is based at least partially on an angular position of the motor.

82. An exercise machine comprising:

a frame comprising a front end and a back end:

a platform arm pivotally connected to the frame about a pivot joint proximate to the front end of the frame and configured to move in a first periodic trajectory;

a handle arm connected to the platform arm and the frame, the handle arm configured to move in a second periodic trajectory;

a support connected to the frame;

an upper control arm pivotally connected to the support and pivotally connected to the handle arm, the upper control arm extending between the support and the handle arm; and a platform bracket pivotally connected to the upper control arm and pivotally connected to the platform arm, the platform bracket extending between the upper control and the platform arm, wherein the handle arm is configured to be moved back and forth by the platform bracket via the platform bracket being moved by the platform arm pivoting about the pivot joint with the upper control arms pivoting about the support.

83. The exercise machine of embodiment 82, wherein the arm linkage mechanism further comprises a lower control arm pivotally connected to the frame proximate to the front end and pivotally connected to the handle arm, and wherein the lower control arm is configured to pivots about both the frame and the handle arm to guide the handle arm back and forth.

84. The exercise machine of claim 82 or 83, further comprising a motor connected to the frame and the platform arm, wherein the motor is configured to drive the platform arm to pivot about the pivot joint to move the handle arm back and forth.

85. A method of flexing and extending a body of a person while exercising, the method comprising performing any of the functions and/or steps associated with the features recited in any one of embodiments 1 to 84.

86. A method of manufacturing an exercise machine for flexing and extending a body of a person while exercising, the method comprising manufacturing any of the features recited in any one of embodiments 1 to 84.

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the inventions are susceptible to various modifications, and alternative forms, specific examples thereof have been shown in the drawings and are herein described in detail. It should be understood, however, that the inventions are not to be limited to the particular forms or methods disclosed, but to the contrary, the inventions are to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "passing a suspension line through the base of the tongue" include "instructing the passing of a suspension line through the base of the tongue." It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. Features of embodiments disclosed herein preceded by a term such as "approximately", "about", and "substantially" as used herein represent the feature with some variability that still performs a desired function or achieves a desired result for that feature.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present subject matter has been described herein in terms of certain embodiments, and certain exemplary methods, it is to be understood that the scope of the subject matter is not to be limited thereby. Instead, the Applicant intends that variations on the methods and materials disclosed herein which are apparent to those of skill in the art will fall within the scope of the disclosed subject matter.

What is claimed is:

1. An exercise machine for flexing and extending a body of a person while exercising, the exercise machine comprising:

a frame configured to rest against a support surface, the frame comprising a front end and a back end;

a first platform arm pivotally connected to the frame about a first pivot joint proximate to the front end of the frame configured to flex and extend at least a portion of a lower body of the body of the person;

a second platform arm pivotally connected to the frame about a second pivot joint proximate to the front end of the frame configured to flex and extend the at least the portion of the lower body of the body of the person;

a first handle arm connected to the first platform arm, the first handle arm configured to move back and forth between the front end and the back end of the frame, wherein the first handle arm is configured to be moved back and forth by the first platform arm pivoting about the first pivot joint, the first handle arm configured to flex and extend at least a portion of an upper body of the body of the person;

a second handle arm connected to the second platform arm, the second handle arm configured to move back and forth between the front end and the back end of the frame, wherein the second handle arm is configured to be moved back and forth by the second platform arm pivoting about the second pivot joint, the second handle arm configured to flex and extend the at least the portion of the upper body of the body of the person;

a motor connected to the frame and the first and second platform arms, wherein the motor is configured to drive the first and second platform arms to pivot about the first and second pivot joints, respectively; and a crank linkage mechanism connecting the motor to the first and second platform arms, wherein the crank linkage mechanism is configured to transfer a rotating movement of the motor into pivoting movement of the first and second platform arms, wherein the crank linkage mechanism comprises:

a drive wheel connected to the motor, wherein the motor is configured to rotate the drive wheel;

a first crank rod and a second crank rod connected to the drive wheel, wherein the first and second crank rods are fixed to the drive wheel to rotate with the drive wheel; and a first connecting rod and a second connecting rod hingedly connected to the first and second crank rods, respectively, and hingedly connected to the first and second platform arms, respectively, wherein the first and second connecting rods are configured to rotate relative to the first and second crank rods and configured to rotate relative to the first and second platform arms, wherein the motor is configured to rotate the first and second crank rods relative to both the first and second connecting rods and the first and second platform arms, wherein the first and second crank rods are configured to move the first and second connecting rods up and down, and wherein the first and second connecting rods are configured to pivot the first and second platform arms about the first and second pivot joints.

2. The exercise machine of claim 1, further comprising an arm linkage mechanism connecting the first and second platform arms with the first and second handle arms, respectively, wherein the arm linkage mechanism is configured to transfer pivoting movement of the first and second platform arms into back and forth movement of the first and second handle arms, respectively.

3. The exercise machine of claim 1, wherein the first and second platform arms are configured to pivot in opposition 180 degrees out of phase with each other about the first and second pivot joints, respectively.

4. The exercise machine of claim 1, wherein the first and second platform arms are configured to pivot together in phase with each other about the first and second pivot joints, respectively.

5. The exercise machine of claim 1, wherein the first and second platform arms are configured to move in a substantially vertical direction relative to the support surface from the perspective of the person.

6. The exercise machine of claim 1, wherein the first and second handle arms are configured to move in a substantially horizontal direction relative to the support surface from the perspective of the person.

7. The exercise machine of claim 1, further comprising one or more dampeners between the frame and the first and second platform arms, the one or more dampeners configured to resist movement of the first and second platform arms depending on the position of the first and second platform arms about the first and second pivot joints, respectively.

8. The exercise machine of claim 7, wherein the one or more dampeners are configured to provide a resistive force against movement of the first and second platform arms to facilitate the person manually exercising on the exercise machine without the first and second platform arms being moved by the exercise machine.

9. The exercise machine of claim 1, further comprising a hydraulic system configured to move the first and second platform arms.

10. The exercise machine of claim 9, wherein the hydraulic system is configured to reciprocate the first and second platform arms and pivot the first and second platform arms about the first and second pivot joints.

11. The exercise machine of claim 2, wherein the arm linkage mechanism comprises:

a first platform bracket connected to the first platform arm and the first handle arm; and a second platform bracket connected to the second platform arm and the second handle arm, wherein the first and second handle arms are configured to be moved back and forth by the first and second platform brackets via the first and second platform brackets being moved by the first and second platform arms pivoting about the first and second pivot joints, respectively.

12. The exercise machine of claim 1, wherein the first and second handle arms each comprise a handle structure, the handle structure comprises a grid extending in at least two dimensions.

13. The exercise machine of claim 1, wherein a length of the first connecting rod is greater than or equal to a length of the first crank rod.

14. The exercise machine of claim 13, wherein a length of the second connecting rod is greater than or equal to a length of the second crank rod.

* * * * *